US011629561B2

(12) United States Patent
Wood et al.

(10) Patent No.: US 11,629,561 B2
(45) Date of Patent: Apr. 18, 2023

(54) BRAKES FOR A TONG

(71) Applicant: Weatherford Technology Holdings, LLC, Houston, TX (US)

(72) Inventors: Kevin Wood, Houston, TX (US); Arne Tjark Becker, Houston, TX (US)

(73) Assignee: WEATHERFORD TECHNOLOGY HOLDINGS, LLC., Houston, TX (US)

( * ) Notice: Subject to any disclaimer, the term of this patent is extended or adjusted under 35 U.S.C. 154(b) by 475 days.

(21) Appl. No.: 16/779,858

(22) Filed: Feb. 3, 2020

(65) Prior Publication Data

US 2021/0238936 A1 Aug. 5, 2021

(51) Int. Cl.
*E21B 19/16* (2006.01)

(52) U.S. Cl.
CPC ..... *E21B 19/161* (2013.01)

(58) Field of Classification Search
CPC ..... E21B 19/161
See application file for complete search history.

(56) References Cited

U.S. PATENT DOCUMENTS

| | | | | |
|---|---|---|---|---|
| 2,618,468 | A * | 11/1952 | Lundeen | E21B 19/164 81/53.2 |
| 2,846,909 | A * | 8/1958 | Mason | E21B 19/164 81/57.2 |
| 3,141,362 | A * | 7/1964 | Tamny | E21B 19/167 81/57.16 |
| 3,704,638 | A | 12/1972 | Nicolson et al. | |
| 3,875,826 | A | 4/1975 | Dreyfuss et al. | |
| 4,346,629 | A | 8/1982 | Kinzbach | |
| 4,867,236 | A | 9/1989 | Haney et al. | |
| 5,501,107 | A | 3/1996 | Snyder et al. | |
| 5,904,075 | A | 5/1999 | Buck | |
| 6,050,156 | A | 4/2000 | Buck | |
| 7,090,254 | B1 | 8/2006 | Pietras et al. | |
| 7,114,235 | B2 | 10/2006 | Jansch et al. | |
| 9,657,539 | B2 | 5/2017 | Gupta et al. | |
| 10,100,593 | B2 | 10/2018 | Musemeche | |
| 10,760,359 | B2 * | 9/2020 | Clasen | E21B 19/10 |
| 2002/0088674 | A1 | 7/2002 | Wassenhoven | |
| 2005/0241442 | A1 | 11/2005 | Neves | |
| 2006/0196316 | A1 | 9/2006 | Slettedal et al. | |
| 2007/0074606 | A1 | 4/2007 | Haise | |
| 2008/0257116 | A1 | 10/2008 | Vatne | |
| 2009/0235786 | A1 | 9/2009 | Stensland | |
| 2009/0277308 | A1 | 11/2009 | Light et al. | |
| 2011/0030512 | A1 | 2/2011 | Begnaud, Jr. | |
| 2011/0067529 | A1 | 3/2011 | Pietras et al. | |

FOREIGN PATENT DOCUMENTS

| | | | |
|---|---|---|---|
| CN | 106522862 | A | 3/2017 |
| CN | 110608001 | A | 12/2019 |
| EP | 3594443 | A2 | 1/2020 |

OTHER PUBLICATIONS

International Search Report and Written Opinion in related application PCT/US2021/013636 dated Mar. 26, 2021.

* cited by examiner

*Primary Examiner* — Aaron L Lembo
(74) *Attorney, Agent, or Firm* — Smith IP Services, PC

(57) ABSTRACT

A tong for handling a tubular includes a jaw carrier having an active jaw movable from a retracted position to an extended position relative to the jaw carrier; a cam body disposed about the jaw carrier and rotatable relative to the cam body; and a brake assembly including an first brake member for engaging an upper surface coupled to the jaw carrier.

15 Claims, 23 Drawing Sheets

BRAKES FOR A TONG

BACKGROUND

Field

Embodiments of the present disclosure generally relate to a rotatable gripping apparatus for a power tong to make-up or break-out a connection between tubulars. In particular, embodiments of the present disclosure generally relate to a brake assembly for a power tong.

Description of the Related Art

It is known in the oil and gas industry to use power tongs with a rotatable gripping apparatus having jaws to make-up or break-out a connection between tubulars. The rotatable gripping apparatus of a conventional power tong have a gap that allows a tubular to be placed into and out of the gripping apparatus for a make-up or break-out operation. This gap, however, remains present during make-up and break-out and prevents a jaw from being placed into engagement with the tubular at the location of the gap. Additionally, when conventional active jaws of power tongs engage a tubular, the active jaws are moved laterally along a direction that is offset from the radius of the tubular. The lateral movement wastes clamping force and can result in the jaws galling the pipe and/or failing to achieve a proper grip necessary to complete a make-up or a break-out operation.

The active jaws are typically moved in and out of a jaw carrier. To move the active jaws, a cam is rotated relative to the jaw carrier. A brake is used to hold the jaw carrier in place to allow relative rotation with the cam.

There is a need for an improved brake assembly for a power tong.

SUMMARY

In one embodiment, a tong for handling a tubular includes a jaw carrier having an active jaw movable from a retracted position to an extended position relative to the jaw carrier; a cam body disposed about the jaw carrier and rotatable relative to the cam body; and a brake assembly including an first brake member for engaging an upper surface coupled to the jaw carrier.

In another embodiment, a tong for handling a tubular includes a jaw carrier having an active jaw movable from a retracted position to an extended position, and a cam body disposed about the jaw carrier and rotatable relative to the cam body. The tong also includes a brake assembly having a rotor coupled to the jaw carrier and a brake device coupled to the tong and configured to engage the rotor to control rotation of the jaw carrier.

In another embodiment, a method of rotating a tubular using a tong includes inserting the tubular into the tong, the tong having a jaw carrier including an active jaw and a cam body; retaining the jaw carrier using a brake assembly; rotating the cam body relative to the jaw carrier to radially extend the active jaw into engagement with the tubular; and rotating the jaw carrier using the cam body. The method also includes disengaging the brake assembly from retaining the jaw carrier; and rotating the tubular gripped by the at least one active jaw.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 2A illustrates the rotary gripping apparatus 200 in a closed configuration. FIG. 2B illustrates the rotary gripping apparatus 200 in an exemplary open configuration. FIG. 2C illustrates another view of the rotary gripping apparatus 200 in the closed configuration to better illustrate a brake 280. FIG. 2D is a cross-sectional view of FIG. 2A.

FIG. 7B-7C illustrate top view of FIG. 7A with the passive jaw assemblies 242*a,b* in different position. FIG. 8A is a partial side view of FIG. 7B. FIG. 8B is a partial side view of FIG. 7C. FIG. 8C is a partial side view of FIG. 7C.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
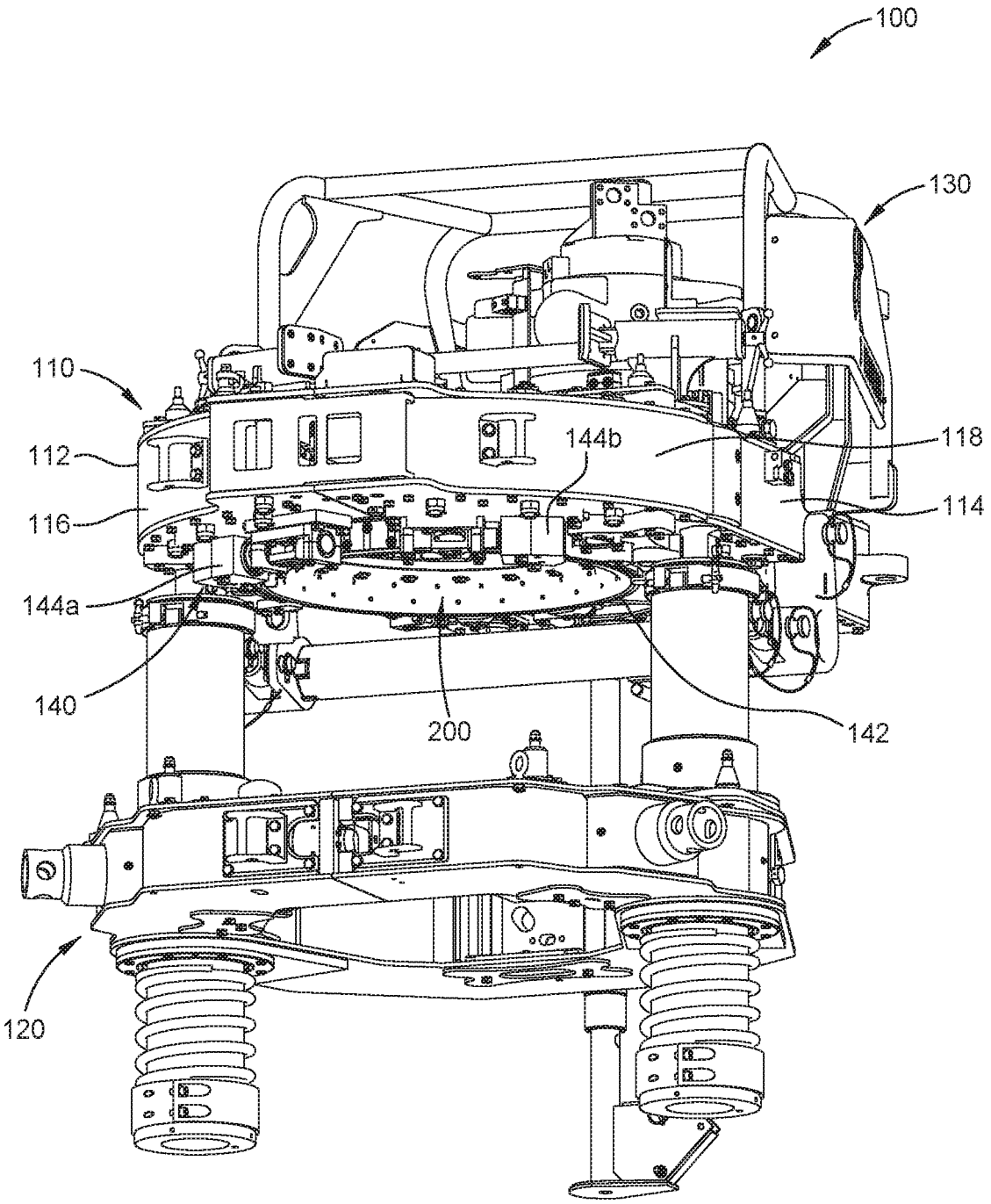
FIG. 1 illustrates a tong assembly 100.

FIG. 1 illustrates a tong assembly 100 having a power tong 110, a backup tong 120, and a motor unit 130. The power tong 110 has a rotary gripping apparatus 200 that is used to grip a tubular for make-up or break-out operations. The drive gear of the power tong 110 rotates the rotary gripping apparatus 200 about a central axis during a make-up or break-out operation. In some embodiments, and as shown in FIG. 1, the rotary gripping apparatus 200 is housed in a tong body 112 of the power tong 110. The tong body 112 has a base body 114, a first body arm 116, and a second body arm 118. The first body arm 116 and the second body arm 118 are moveable from a closed position (shown in FIG. 1) to an open position to convert the rotary gripping apparatus 200 from a closed configuration to an open configuration, and vice versa, to facilitate placing a tubular into the rotary gripping apparatus 200 or to remove a tubular from the rotary gripping apparatus 200. The power tong 110 additionally has a brake band assembly 140, which includes a brake band 142 and one or more actuators 144. In some embodiments as shown in FIG. 1, the brake band assembly 140 is disposed on an underside of the power tong 110. The brake band assembly 140 selectively applies a brake force to a brake 280 of the rotary gripping apparatus 200. The one or more actuators 144, such as first and second actuators 144*a,b*, are configured to move the brake band 142 into engagement or disengagement with the brake 280. As shown in FIG. 1, the first actuator 144*a* may be disposed on the first body arm 116, and the second actuator 144*b* may be disposed on the second body arm 118.

Figure 2A:
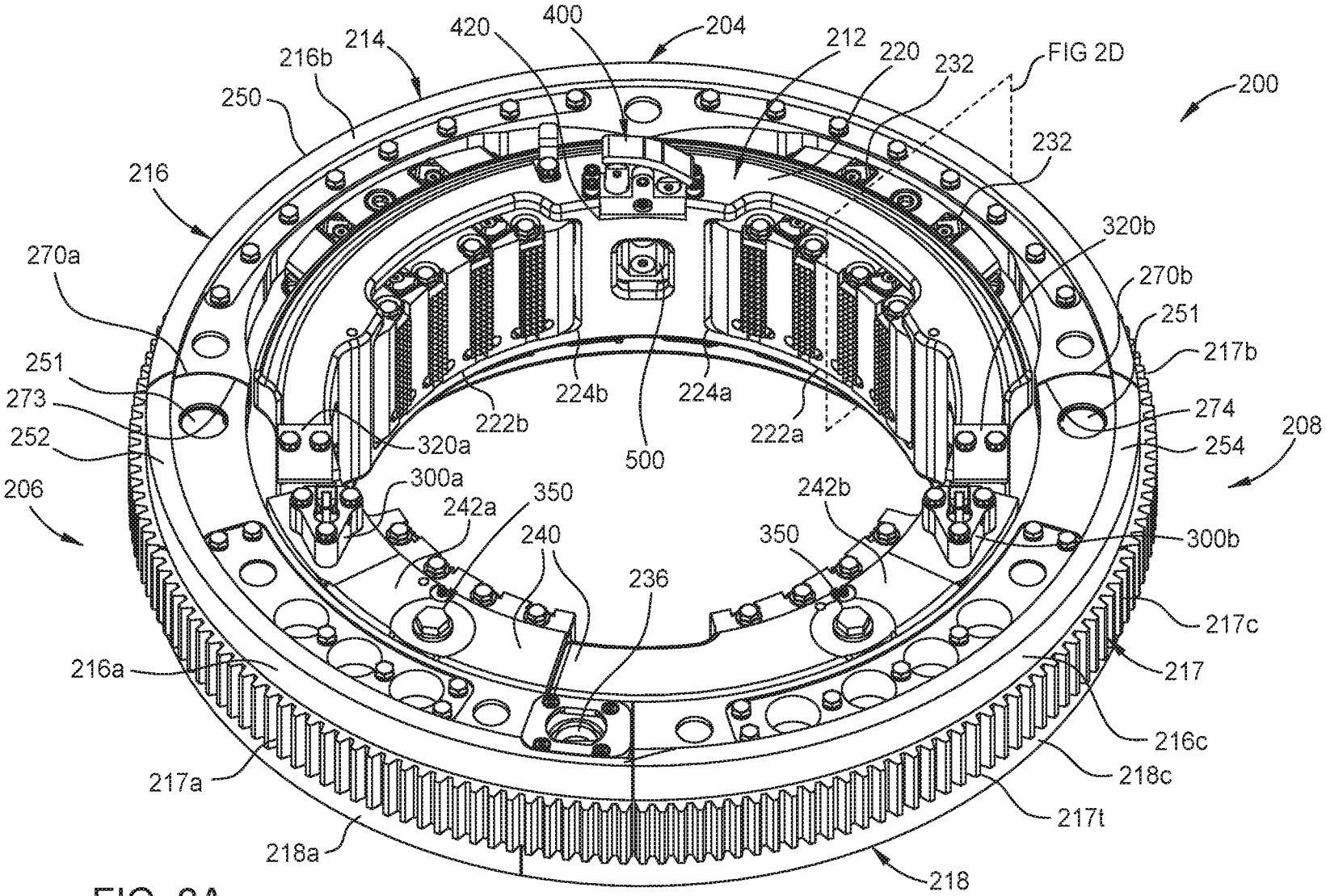
FIG. 2A-2D illustrate a rotary gripping apparatus 200.

FIGS. 2A-2D illustrate an embodiment of the rotary gripping apparatus 200. The rotary gripping apparatus 200 includes a rotary base 204, a first rotary arm 206, and a second rotary arm 208. When the rotary gripping apparatus 200 is in the neutral alignment as shown in FIG. 2A, the first rotary arm 206 and the second rotary arm 208 are pivotable relative to the rotary base 204 from a closed position to an open position to form a gap 210, and from the open position to the closed position to close the gap 210.

Figure 2B:
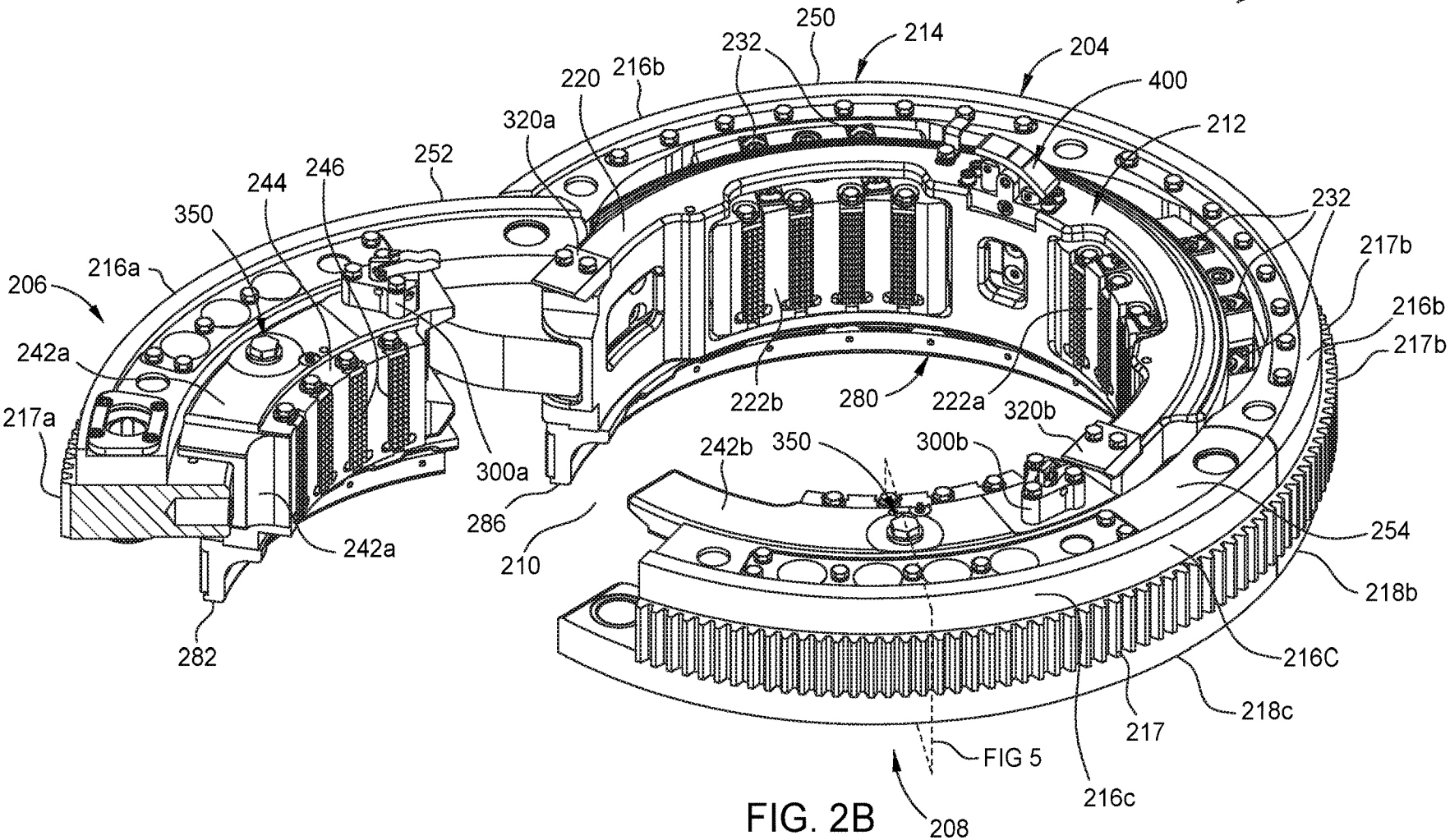

When the rotary gripping apparatus 200 is in the closed configuration, as shown in FIG. 2A, the first rotary arm 206 and the second rotary arm 208 are in their respective closed positions such that the rotary gripping apparatus 200 is an enclosed ring. The rotary gripping apparatus 200 is ready to make-up or break-out a tubular connection when in the closed configuration. The rotary gripping apparatus 200 is in the open configuration when at least one of the first and second rotary arms 206, 208 is moved to the open position. FIG. 2B illustrates an example of an open configuration, where the first rotary arm 206 is in the open position but the second rotary arm 208 remains in the closed position. However, it is contemplated that both the first rotary arm 206 and the second rotary arm 208 can be in the open position when the rotary gripping apparatus 200 is in the open configuration. When the rotary gripping apparatus 200 is in the open configuration, the rotary gripping apparatus 200 is an open ring having the gap 210. A tubular may be inserted into or removed from the rotary gripping apparatus 200 via the gap 210. Once the tubular has cleared the gap 210, the respective first and/or second rotary arms 206, 208 that are in the open position are moved back to the closed position to close the gap 210 and return the rotary gripping apparatus 200 to the closed configuration.

Figure 2C:
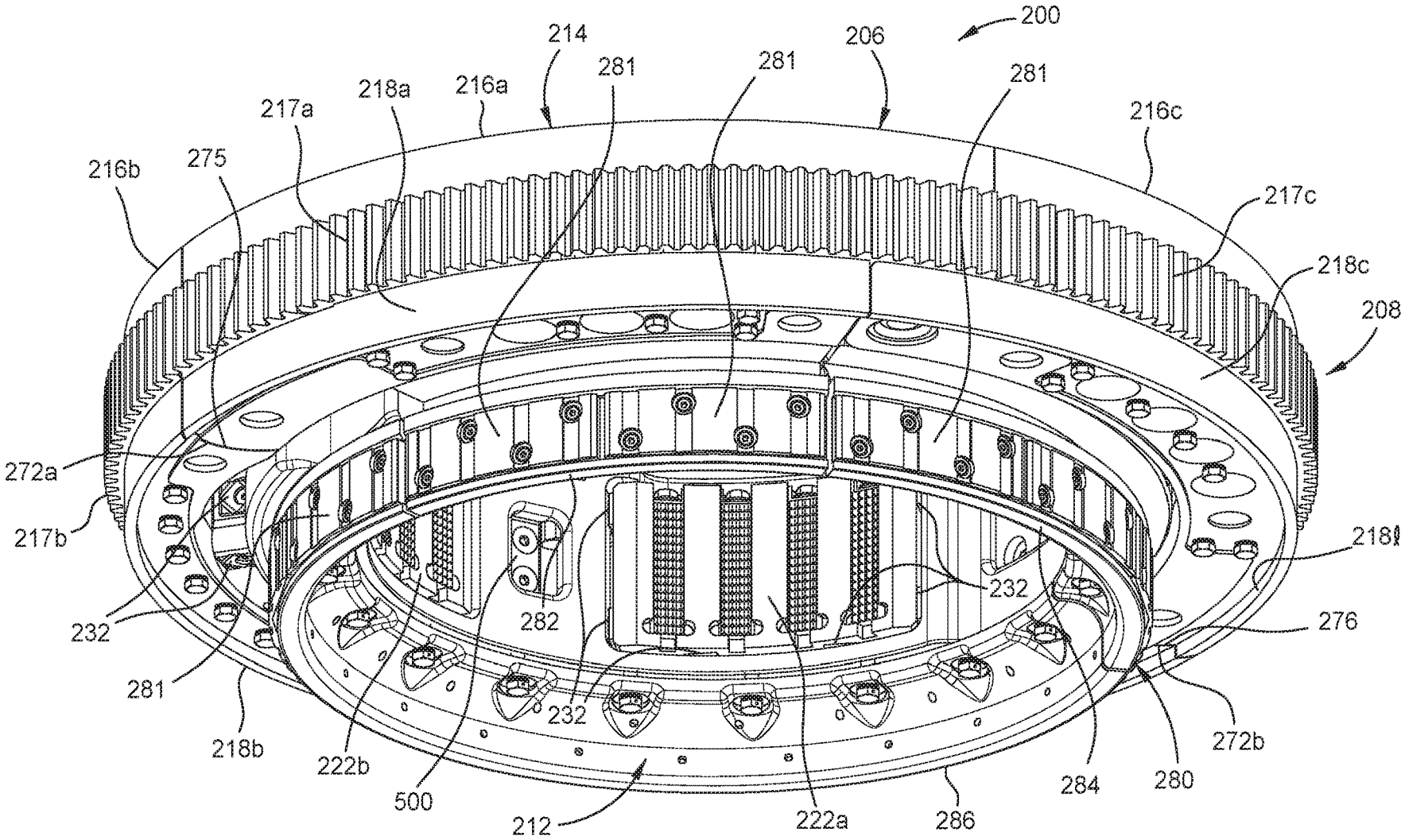
Figure 2D:
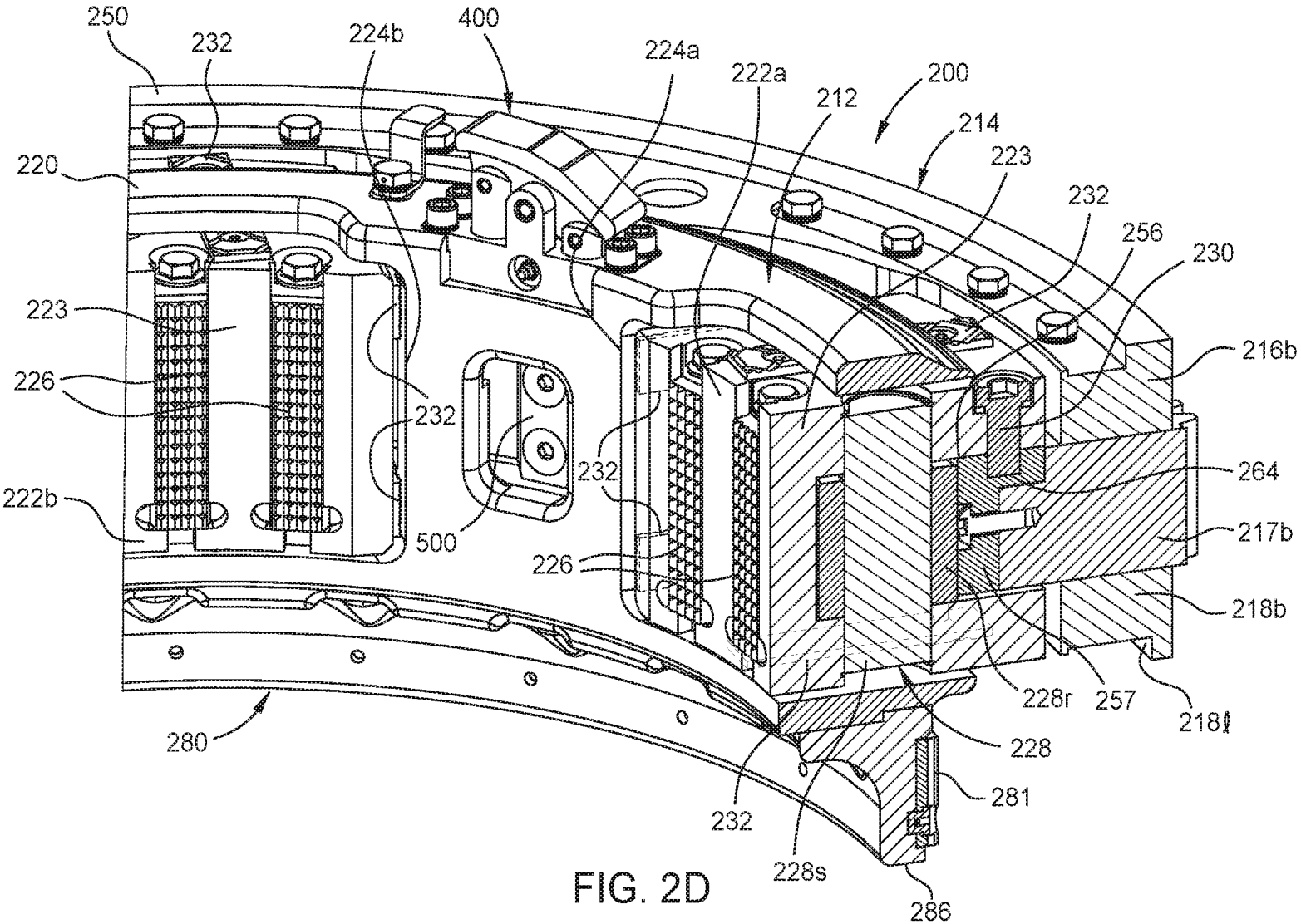

The rotary gripping apparatus 200 has a jaw carrier 212 and a cam body 214. In the embodiment illustrated in FIGS. 2A-2D, the jaw carrier 212 has an active jaw portion 220, a passive jaw portion 240, and a brake 280. The active jaw portion 220 is a jaw base of the jaw carrier 212. As shown in FIGS. 2A and 2B, the active jaw portion 220 has two active jaws 222*a,b* disposed in a respective jaw cavity 224*a,b*. FIG. 2D illustrates a cross section of the rotary gripping apparatus 200 to show a cross section of the active jaw 222*b*. The active jaws 222 have a body 223, gripping elements 226, a roller assembly 228, and a follower member 230. As shown in FIG. 2D, the gripping elements 226 are attached to the body 223. In some embodiments, the gripping elements 226 will be integrally formed with the body 223. The roller assembly 228 includes a shaft 228*s* and a roller 228*r*. The roller assembly 228 may be attached to or integral with the body 223. The follower member 230 may be a pin as shown in FIG. 2D. Each active jaw 222*a,b* is radially moveable relative to the jaw carrier 212 in the respective jaw cavity 224*a,b*. Radial movement is defined as movement along a radius of the rotary gripping apparatus 200. One or more slide bearings 232 may be disposed in each jaw cavity 224 to facilitate the radial movement of the active jaws 222 with respect to the jaw carrier 212 and cam body 214. As shown in FIG. 2D, some of the slide bearings 232 are shown as dashed lines.

The passive jaw portion 240 includes a first passive jaw assembly 242*a* and a second passive jaw assembly 242*b*. Each passive jaw assembly 242*a,b* has a passive jaw 244*a,b* having gripping members 246. Unlike the active jaw 222, each passive jaw 244 is not radially movable with respect to the jaw carrier 212. In some embodiments, the gripping members 246 are attached to the passive jaw 244. In other embodiments, the gripping members 246 are formed integrally with the passive jaw 244. In the closed configuration, each passive jaw assembly 242*a,b* interfaces with the active jaw portion 220 such that the jaw carrier 212 forms an enclosed ring. In the open configuration, one or both of the passive jaw assemblies 242*a,b* has been moved with respect to the active jaw portion 220. The first passive jaw assembly 242*a* is a first jaw arm and the second passive jaw assembly 242*b* is a second jaw arm.

The cam body 214 is disposed about the jaw carrier 212. The cam body 214 forms an enclosed ring around the jaw carrier 212 when the rotary gripping apparatus 200 is in the closed configuration. The cam body 214 has a cam base 250, a first cam arm 252, and a second cam arm 254. The first cam arm 252 and the second cam arm 254 are pivotally coupled to the cam base 250, such as by a pivot pin 251. The cam body 214 has gear teeth 217*t* disposed on an outer surface, and the gear teeth 217*t* encircle the cam body 214. The drive gear (not shown) of the power tong 110 may engage the gear teeth 217*t* to rotate the rotary gripping apparatus 200.

In some embodiments, gear teeth 217*t* are formed on or attached to the gear member 217 of the cam body 214. The gear member 217 may be disposed between a first body member 216 and a second body member 218 as shown in FIGS. 2A-2D. The first body member 216 and the second body member 218 may be attached to the gear member 217 using suitable fasteners, such as bolts, screws, and/or by welds. The first body member 216 is made of three segments: a first arm segment 216*a*, a base segment 216*b*, and a second arm segment 216*c*. The gear member 217 is made up of three segments: a first arm segment 217*a*, a base segment 217*b*, and a second arm segment 217*c*. As shown in FIG. 2C, the second body member 218 is made of three segments: a first arm segment 218*a*, a base segment 218*b*, and a second arm segment 218*c*. The first cam arm 252 includes the first arm segment 216*a*, the first arm segment 217*a*, and the first arm segment 218*a*. The second cam arm 254 includes the second arm segment 216*c*, the second arm segment 217*c*, and the second arm segment 218*c*. The cam base 250 includes the base segment 216*b*, the base segment 217*b*, and the base segment 218*b*. The pivot pin 251 for the first cam arm 252 is disposed in a bore through the first arm segment 216*a*, the base segment 217*b*, and the first arm segment 218*a*. The pivot pin 251 of the second cam arm 254 is disposed in a bore formed through the second arm segment 216*c*, the base segment 217*b*, and the second arm segment 218*c*.

Figure 7A:
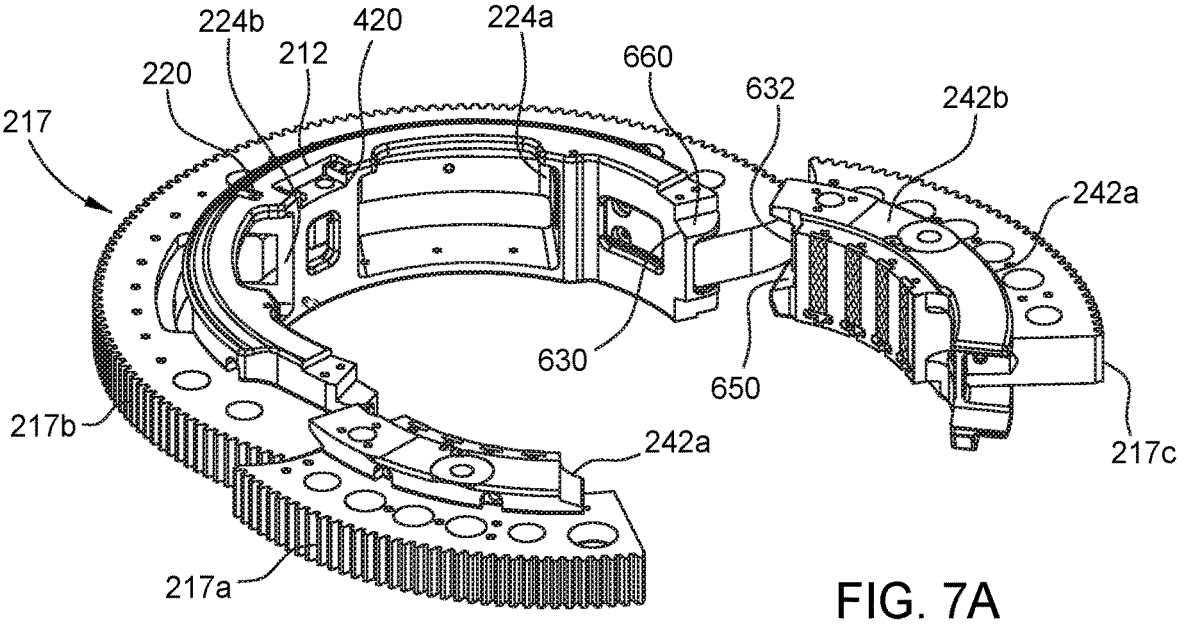
FIGS. 7A-7D and 8A-8C illustrate the rotary gripping apparatus 200 without the first body member 216, the second body member 218, the active jaws 222, the alignment assembly 350, the make/break switch 400, and the stop key 500 to better illustrate the movement of the passive jaw assemblies 242*a,b* relative to the active jaw portion 220 of the jaw carrier 212.
Figure 7B:
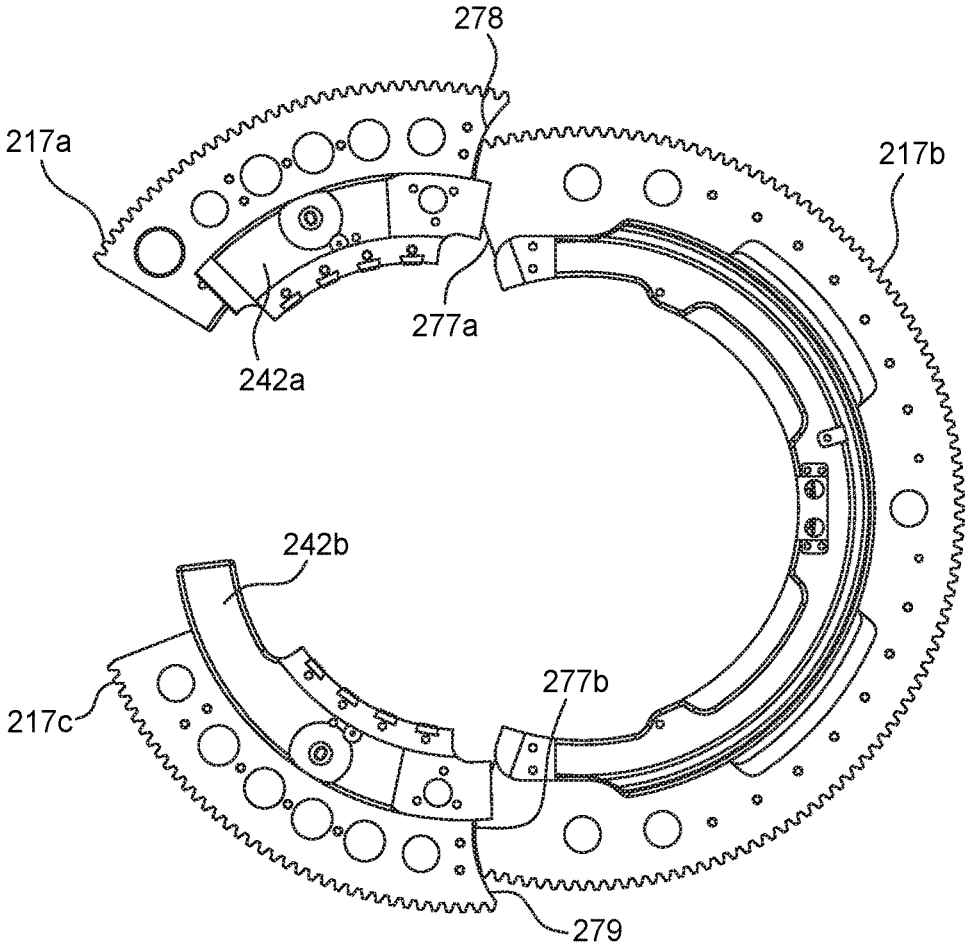

In some embodiments, and as shown in FIG. 2A, the base segment 216*b* has two tapered surfaces 270*a,b* disposed at opposite ends of the base segment 216*b*. In some embodiments, and as shown in FIG. 2C, the base segment 218*b* has two tapered surfaces 272*a,b*. The first arm segment 216*a* has a tapered surface 273 disposed at one end corresponding to the tapered surface 270*a* of the base segment 216*b*. The tapered surfaces 270*a*, 273 are configured to allow the first arm segment 216*a* to move relative to the base segment 216*b*. The second arm segment 216*c* has a tapered surface 274 disposed at one end corresponding to the tapered surface 270*b*. The tapered surfaces 270*b*, 274 are configured to allow the second arm segment 216*c* to move relative to the base segment 216*b*. As shown in FIG. 2C, the first arm segment 218*a* has a tapered surface 275 disposed at one end corresponding to the tapered surface 272*a* of the base segment 218*b*. The tapered surfaces 272*a*, 275 are configured to allow the first arm segment 218*a* to move relative to the base segment 218*b*. As shown in FIG. 2C, the second arm segment 218*c* has a tapered surface 276 disposed at one end corresponding to the tapered surface 272*b*. The tapered surfaces 272*b*, 276 are configured to allow the second arm segment 218*c* to move relative to the base segment 218*b*. The base segment 217*b*, as shown in FIG. 7B has two tapered surfaces 277*a,b* disposed at opposite ends. The first arm segment 217*a* of the gear member 217 has a tapered surface 278 disposed at one end corresponding to the tapered surface 277*a*. The tapered surfaces 277*a*, 278 are configured to allow the first arm segment 217*a* move relative to the base segment 217*b*. The second arm segment 217*c* has a tapered surface 279 corresponding to tapered surface 277*b*. The tapered surfaces 277*b*, 279 are configured to allow the second arm segment 217*c* to move relative to the base segment 217*b*.

Figure 3:
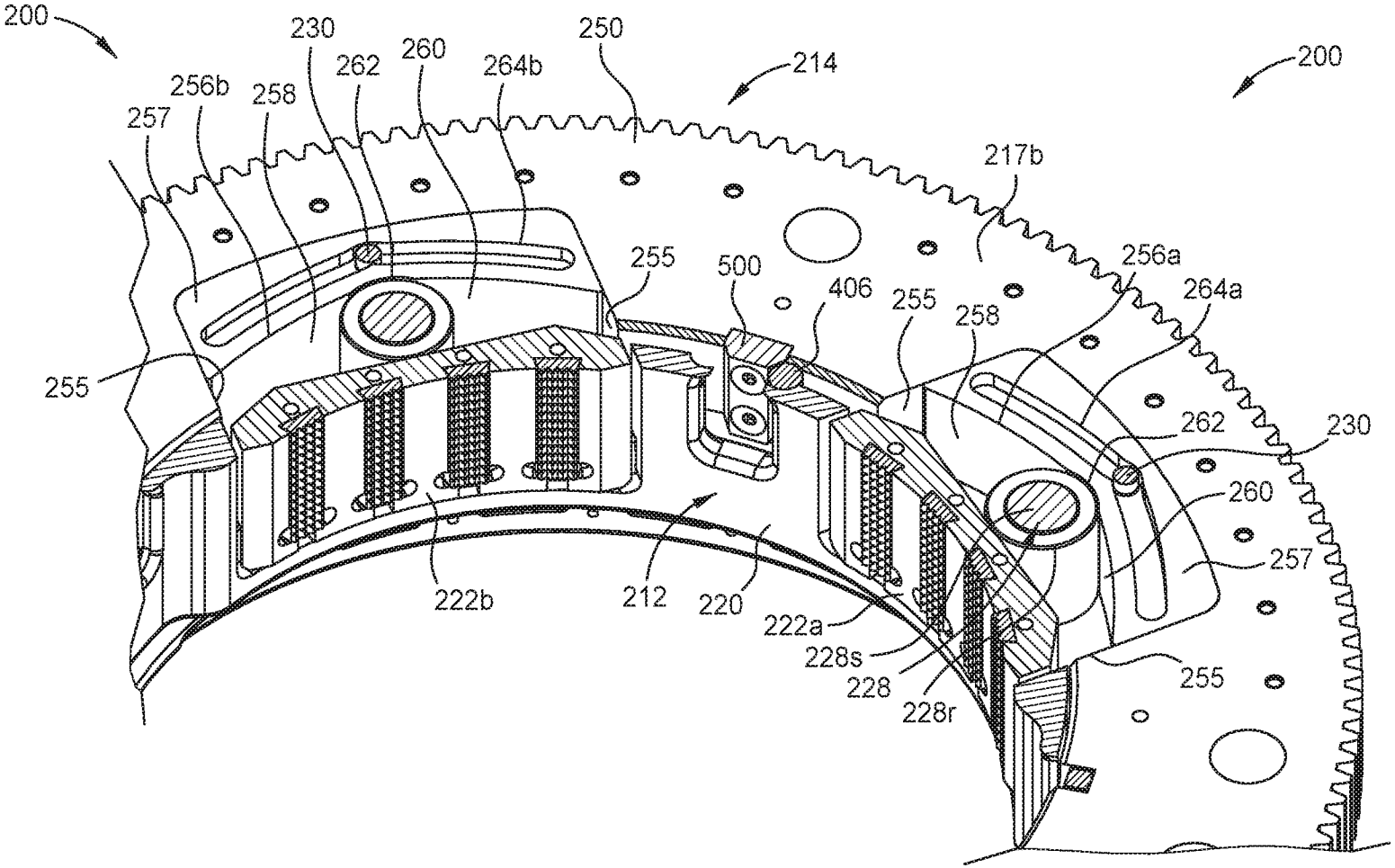
FIG. 3 illustrates a partial cross section of the rotary gripping apparatus 200.

FIG. 3 is a cross-sectional view of one embodiment of the rotary gripping apparatus 200. As shown, the cam base 250 has a two cams 256*a, b*. Each cam 256 corresponds to an active jaw 222. In the illustrated embodiment, cam 256*a* corresponds to active jaw 222*a* and cam 256*b* corresponds to active jaw 222*b*. Each cam 256 has a first cam face 258, a second cam face 260, and a third cam face 262. The third cam face 262 is disposed between the first cam face 258 and the second cam face 260. In some embodiments, the third cam face 262 is a recess and the first cam face 258 and the second cam face 260 are inclined relative to the third cam face 262. The cam body 214 also includes a slot 264, such as slots 264*a,b*, corresponding to each cam 256. The slot 264 is contoured to follow the cam 256. As shown in FIG. 3, the roller 228*r* of the active jaw 222 is engaged with the third cam face 262. However, the roller 228*r* may roll along the first cam face 258 and/or the second cam face 260. The follower member 230 is partially disposed in the slot 264. As shown in FIG. 2D, the cam 256 and slot 264 may be part of an attachment 257 that is secured, for example, to the gear member 217 via bolts, screws, and/or welds. However, each cam 256 and/or each slot 264 may be integrally formed with the cam body 214.

When the rotary gripping apparatus 200 is in the closed configuration, the cam body 214 is rotatable relative to the jaw carrier 212 in one direction to extend the active jaws 222*a,b* from a radially retracted position to a radially extended position. For example, as the cam body 214 is rotated in a clockwise direction relative to the jaw carrier 212, the roller assembly 228 moves along the inclined first cam face 258, thereby moving the active jaw 222 to the radially extended position. The follower member 230 also moves in the slot 264 as the active jaw 222 moves from the radially retracted position to the radially extended position. The active jaws 222*a,b* can be moved from the radially extended position to the radially retracted position by the rotation of the cam body 214 with respect to the jaw carrier 212 in the opposite direction, which moves the roller assembly 228 down the inclined first cam face 258 and the follower member 230 back along the slot 264 to cause the radial retraction of the active jaw 222. Thus, the cam 256 causes the radial extension of the active jaw 222 when the cam body 214 is rotated in one direction, and the follower member 230 causes the radial retraction of the active jaw 222 as the follower member 230 moves in the slot 264 when the cam body 214 is rotated in the opposite direction. In some embodiments, the engagement of the follower member 230 with the slot 264 connects the active jaw 222 to the jaw carrier 212 such that the active jaw 222 does not fall out of the jaw carrier 212.

For example, the first cam face 258 is configured to move an active jaw 222 from the radially retracted position to the radially extended position when the cam body 214 rotates relative to the jaw carrier 212 in a clockwise direction. The cam body 214 may rotate in the clockwise direction during a make-up operation. The roller assembly 228 moves along the first cam face 258 as the active jaw 222 extends. In order to move the active jaw 222 from the radially extended position to the radially retracted position, the cam body 214 rotates in a counter-clockwise direction and the follower member 230 follows the slot 264 to retract the active jaw 222 as the roller assembly 228 moves along the first cam face 258. In another example, the second cam face 260 is configured to move the active jaw 222 from the retracted position to the extended position when the cam body 214 rotates relative to the jaw carrier 212 in a counter-clockwise direction. The cam body 214 may rotate in the counter-clockwise direction during a break-out operation. The roller assembly 228 moves along the second cam face 260 as the active jaw 222 extends. In order to move the active jaw 222 from the radially extended position to the radially retracted position, the cam body 214 rotates in a clockwise direction relative to the jaw carrier 212 and the follower member 230 follows the slot 264 to retract the active jaw 222 as the roller assembly 228 moves along the second cam face 260. When the active jaws 222 are in a retracted position, as shown in FIG. 3, the roller assembly 228 is engaged with the third cam face 262.

In some embodiments, the active jaws 222 have a biasing member, such as a spring, configured to retract the active jaw 222 instead of the follower member 230 in the slot 264. The biasing member biases the active jaw 222 toward the retracted position. The biasing member is disposed in the jaw cavity 224. One end of the biasing member is coupled to the active jaw 222 and other end is coupled to the jaw carrier 212. For example, when the cam body 214 rotates relative to the jaw carrier 212 in a direction to radially extend the active jaws 222, the biasing member is stretched. When the cam body 214 rotates relative to the jaw carrier 212 in an opposite direction, the biasing member contracts and pulls the active jaw 222 back to the radially retracted position. In some embodiments including the biasing member to retract the active jaws 222, the rotary gripping apparatus 200 includes the follower member 230 that is partially disposed in a slot, such as slot 264.

When the active jaws 222 are moved from the radially retracted position to the radially extended position, the extension of the active jaws 222 is limited by either the outer diameter of the tubular being gripped and/or the distance that the roller assembly 228 can travel along the cam 256, such as along the first cam face 258 or the second cam face 260. Once the active jaw 222 is prevented from further extension, the jaw carrier 212 and cam body 214 become rotationally locked. This allows the drive gear of the power tong 110 to rotate the entire rotary gripping apparatus 200 to make-up or break-out the tubular gripped by the active jaws 222 and the passive jaws 244. For example, the extension of the active jaw 222 may be limited by the engagement of the roller assembly 228 with one of the walls 255 adjacent the cam 256. Once the roller assembly 228 engages with the wall 255, then the cam body 214 is prevented from continued rotation relative to the jaw carrier 212. As a result, the cam body 214 and the jaw carrier 212 are rotationally locked. When the cam body 214 and jaw carrier 212 are rotationally locked, the tubular gripped by the active jaws 222 and passive jaws 244 can be rotated by the rotation of the rotary gripping apparatus 200.

When the rotary gripping apparatus 200 is in the closed configuration, the cam body 214 is rotatable relative to the jaw carrier 212 to facilitate the engagement of the jaws 222, 244 with a tubular for a make-up or break-out operation. When it is desired to introduce another tubular into the rotary gripping apparatus 200, at least one of the first rotary arm 206 and second rotary arm 208 move relative to the rotary base 204 from the closed position to the open position to form the gap 210. When the rotary gripping apparatus 200 is converted from the closed configuration to the open configuration to form the gap 210, the first passive jaw assembly 242*a* and first cam arm 252 are attached together by a lock 300*a* to form the first rotary arm 206, and the second passive jaw assembly 242*b* and the second cam arm 254 are attached together with a lock 300*b* to form the second rotary arm 208. The locks 300*a,b* prevent the respective passive jaw assembly 242 from falling off the respective cam arm 252, 254 when the rotary gripping apparatus 200 is in the open configuration. After a new tubular has cleared the gap 210, the rotary gripping apparatus 200 may be converted back to the closed configuration, and the lock 300*a* unlocks to release the first passive jaw assembly 242*a* from the first cam arm 252 and the lock 300*b* unlocks to release the second passive jaw assembly 242*b* from the second cam arm 254. The rotary gripping apparatus 200 may be converted to the open configuration to remove the tubular disposed in the rotary gripping apparatus 200.

As shown in FIG. 2A, the active jaws 222 are disposed directly across from a corresponding passive jaw 244. Thus, the active jaw 222*a* moves radially toward and away from the passive jaw 244*a*, and the active jaw 222*b* moves radially toward and away from the passive jaw 244*b*. The active jaws 222 move radially between the retracted and extend positons with substantially no lateral movement relative to the radius of the rotary gripping apparatus 200 due to the slide bearings 232 and the rolling engagement of the roller assembly 228 with the cam 256. Lateral movement of the active jaw 222 relative to the radius of the rotary gripping apparatus 200 is mitigated or does not occur at all. Thus, when an active jaw 222 grips a tubular, it imparts no lateral forces, or substantially no lateral forces, to the tubular. Thus, the force applied by the active jaw 222 to the gripped tubular is perpendicular to the tubular. The mitigation of lateral forces applied to the tubular by the active jaw 222 decreases the chance that the active jaw 222 fails to grip the tubular and decreases galling of the tubular.

Figures 4A, 4B:
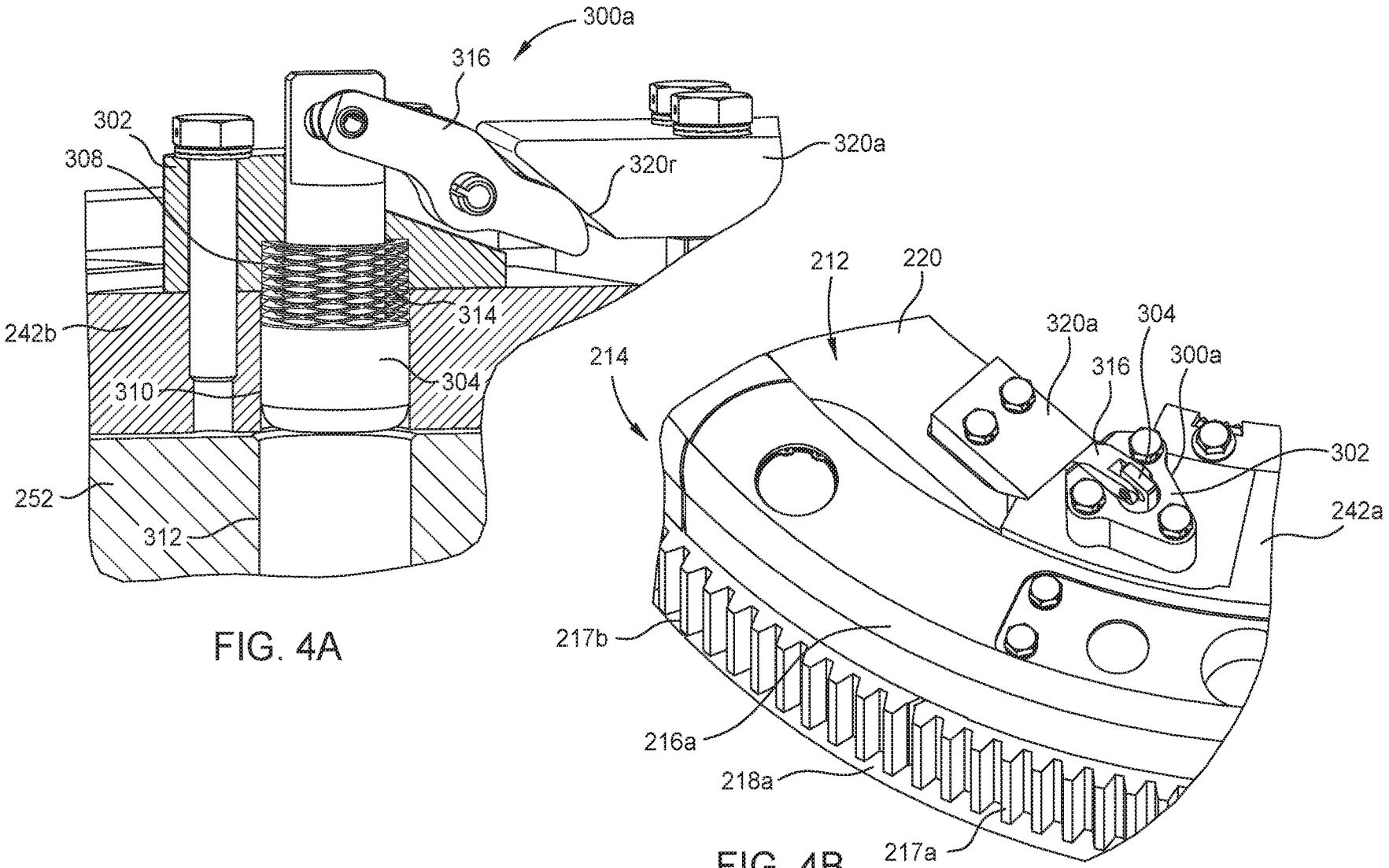
FIGS. 4A and 4B illustrate a lock 300 and a release member 320.

FIGS. 4A and 4B illustrate one embodiment of the lock 300. As shown, the lock 300 may be coupled to the passive jaw assembly 242, such as the first passive jaw assembly 242*a*. The lock 300 includes a housing 302, a locking member 304, a biasing member 314, and a lever member 316. FIGS. 4A-4B illustrate lock 300*a*, but lock 300*b* may have the same structure and principle of operation. In the illustrated embodiment in FIG. 2A-2B, the locks 300*a,b* are identical. The housing 302 may be attached to the passive jaw assembly 242, via a bolt, screw, and/or weld connection. The locking member 304 is at least partially disposed in a bore 308 of the housing 302. In an unlocked configuration, as shown in FIG. 4A, the locking member 304 may also be partially disposed in a bore 310 of the passive jaw assembly 242. The first and second cam arms 252, 254 have a recess 312. In a locked configuration, the locking member 304 has been displaced such that locking member 304 is partially disposed in the recess 312. In some embodiments, the recess 312 is a bore. The biasing member 314 is disposed about a portion of the locking member 304 and biases the lock 300 towards the locked configuration. When the locks 300*a,b* are in the locked configuration, the locks 300*a,b* attach the respective first and second passive jaw assemblies 242*a,b* with the respective first or second cam arms 252, 254.

When the rotary gripping apparatus 200 is in the closed configuration, the lock 300 is maintained in the unlocked configuration by the engagement of the lever member 316 with a release member 320 coupled to the active jaw portion 220. FIGS. 2A and 2B illustrate the jaw carrier 212 having two release members 320*a,b*. The release member 320*a* is illustrated in FIG. 4A. The lever member 316 may be pivotally coupled to the housing 302 and the locking member 304. The lever member 316 is engaged with the release member 320 when the rotary gripping apparatus 200 is in the closed configuration, and the biasing force of the biasing member 314 is overcome such that the locking member 304 is not disposed in the recess 312. As the rotary gripping apparatus 200 opens, the lever member 316 slides along a ramp surface 320*r* of the release member 320, and the biasing member 314 moves the locking member 304 into the recess 312 such that the lock 300 is in the locked configuration. In some embodiments, the lever member 316 is completely disengaged with the release member 320 before the biasing member 314 moves the locking member 304 into the recess 312 such that the lock 300 is in the locked configuration.

As shown in FIG. 2A, each lock 300*a,b* has a corresponding release member 320*a,b*. In some embodiments, the lock 300 is a pin lock, or some other suitable lock to selectively attach, for example, the first passive jaw assembly 242*a* to the first cam arm 252. In some embodiments, it is contemplated that lock the 300*a* will be different than the lock 300*b*, and vice versa.

Figure 5:
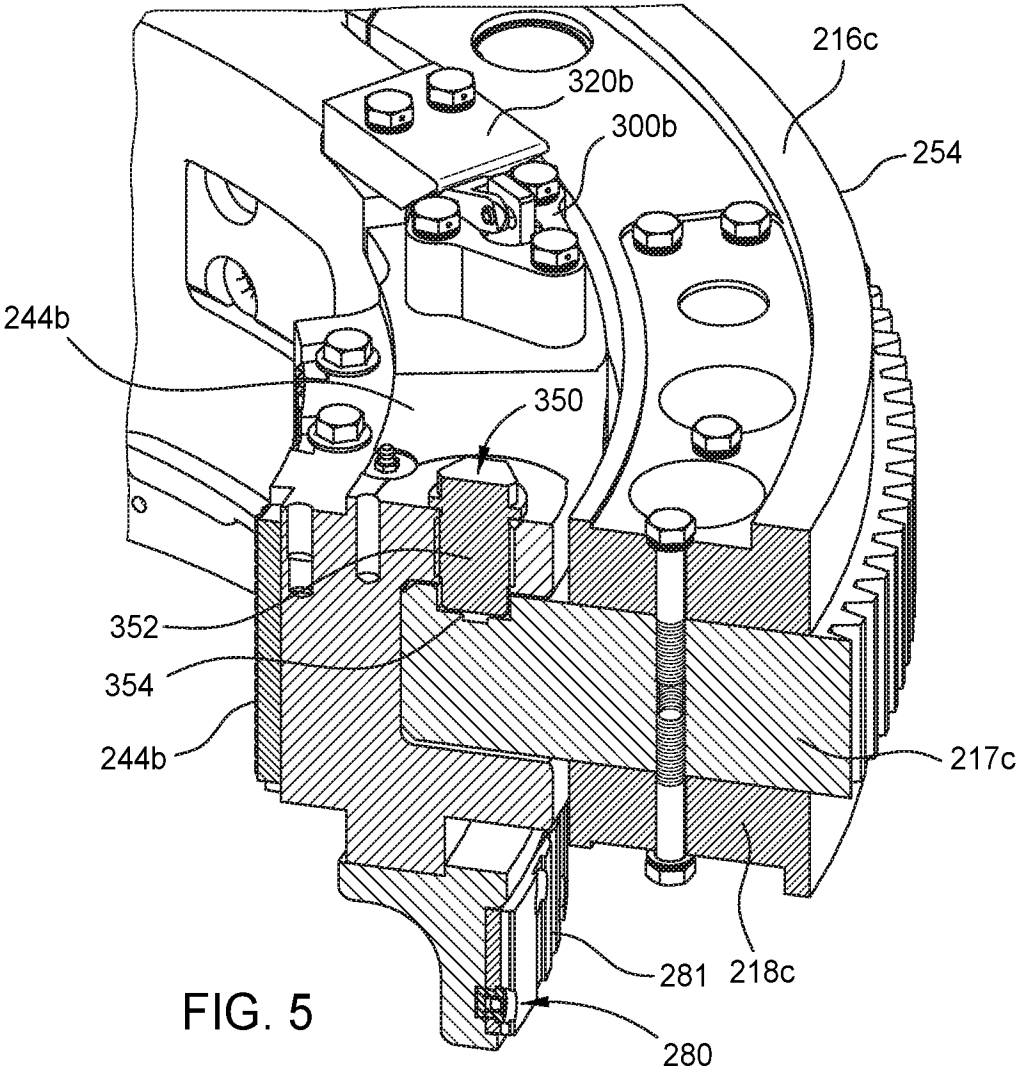
FIG. 5 is a cross-sectional view of FIG. 2B and illustrates an arm alignment assembly 350.

In some embodiments, each passive jaw assembly 242 has an arm alignment assembly 350 as shown in FIG. 5. FIG. 5 is a cross sectional view of the rotary gripping apparatus 200. The arm alignment assembly 350 has an alignment member 352 disposed in a slot 354 formed in the respective first and second cam arms 252, 254. In this embodiment, the slot 354 may be formed in the gear member 217. For example, the first arm segment 217*a* and the second arm segment 217*c* each have a slot 354. In some embodiments, the alignment member 352 is a bolt attached to the passive jaw assembly 242. In some embodiments, the alignment member 352 includes a spring biasing a ball into engagement with the slot 354. In some embodiments, the slot 354 has a length corresponding to the maximum amount of rotation of the cam body 214 can rotate relative to the jaw carrier 212. The slot 354 and the alignment member 352 interact to guide relative rotational movement between the cam body 214 and the jaw carrier 212. For example, the alignment assembly 350 of the first passive jaw assembly 242*a* keeps the first passive jaw assembly 242*a* aligned with the first cam arm 252, and the alignment assembly 350 of the second passive jaw assembly 242*b* keeps the second passive jaw assembly 242*b* aligned with the second cam arm 254.

When the alignment assembly 350 is used in conjunction with a lock 300, the alignment assembly 350 prevents the passive jaw assemblies 242*a,b* from pivoting with respect to its respective cam arms 252, 254 about the respective locks 300*a,b* when the locks 300*a,b* are in the locked configuration. Thus, the lock 300 and the alignment assembly 350 provide two points of restraint against relative movement of the passive jaw assemblies 242*a,b* with respect to the corresponding cam arms 252, 254 after the rotary gripping apparatus 200 is opened.

Referring back to FIG. 2A, the rotary gripping apparatus 200 has a bore 236 formed through the first cam arm 252 and the second cam arm 254. When the rotary gripping apparatus 200 is in the closed configuration, a pin or other suitable fastener (not shown) may be inserted into the bore 236 to lock the first cam arm 252 to the second cam arm 254. The pin or other suitable fastener will be removed from the bore 236 prior to opening the rotary gripping apparatus 200.

Figure 6B:
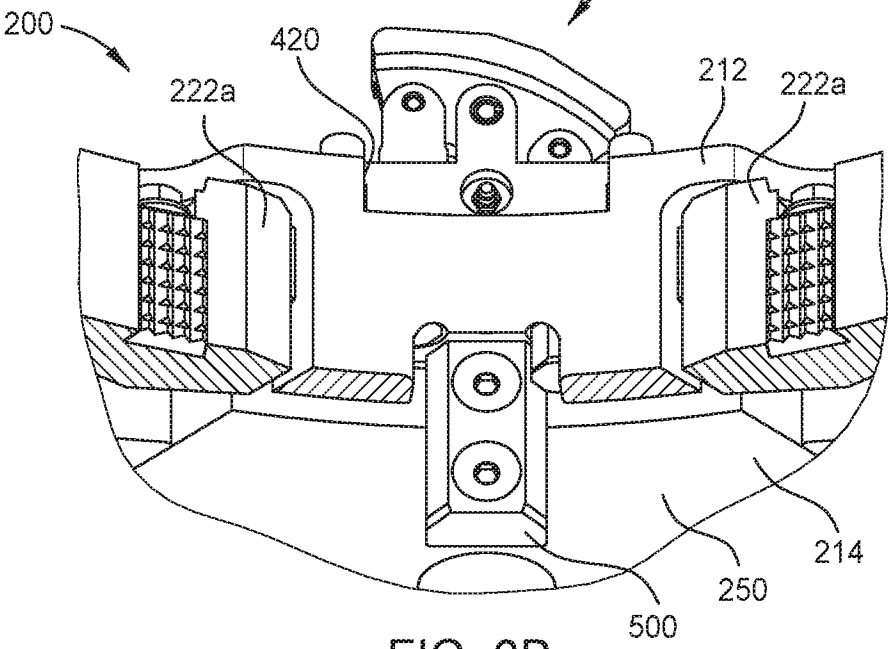
FIG. 6B is a partial cross-sectional view of the rotary gripping apparatus 200 and illustrates the make/break switch 400 in the first configuration and a stop key 500.
Figure 6A:
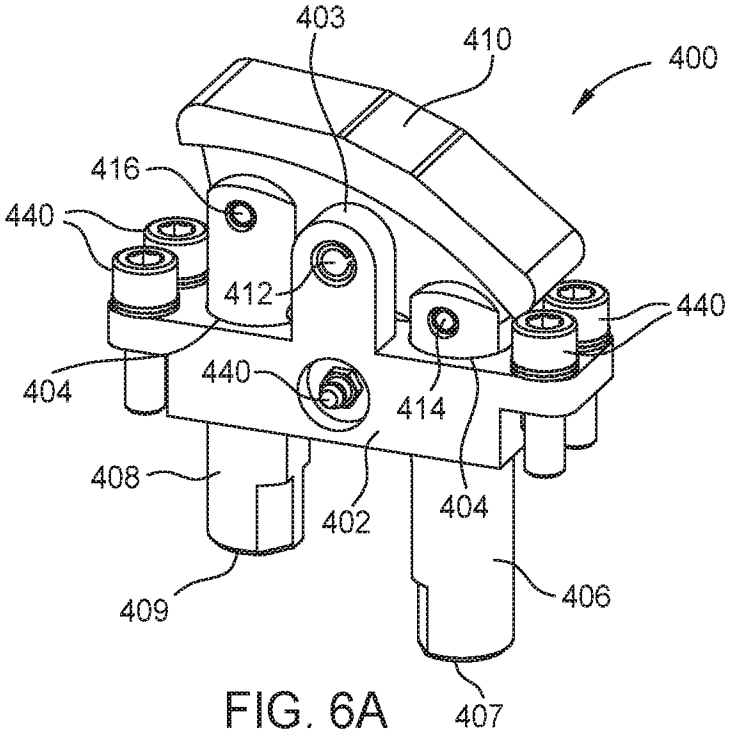
FIG. 6A illustrates a make/break switch 400 in a first configuration.
Figure 6C:
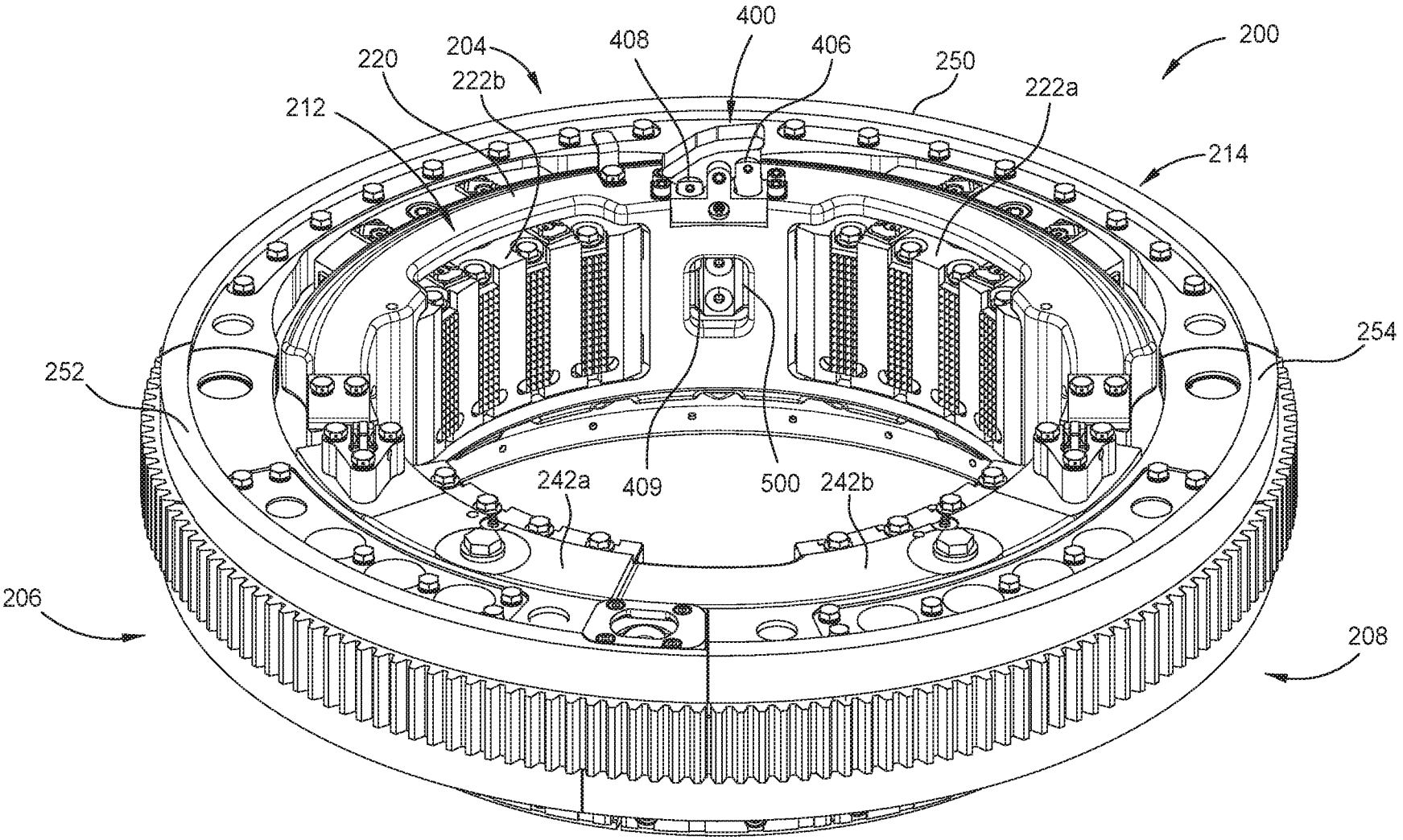
FIG. 6C illustrates the rotary gripping apparatus 200 with the make/break switch 400 in a second configuration.

FIGS. 6A-C illustrate an exemplary embodiment of a make/break switch 400. The make/break switch 400 has a body 402, a first stop member 406, a second stop member 408, and a switch member 410. The body 402 has a bore 404 for both the first stop member 406 and the second stop member 408. The switch member 410 is pivotally coupled to the body 402 at pivot point 412, such as by a pin or bolt attachment. The switch member 410 is attached to the first stop member 406 by a first pivotable attachment 414, such as by a screw or bolt. The switch member 410 is attached to the second stop member 408 by a second pivotable attachment 416, such as by a screw or bolt. The make/break switch 400 may be attached to the jaw carrier 212 (as shown in FIG. 2A) via a plurality of fasteners 440. As shown in FIG. 6B, the make/break switch 400 may be at least partially disposed in a make/break switch recess 420 of the jaw carrier 212. As shown, the make/beak switch recess 420 is formed in the active jaw portion 220. In some embodiments, the first stop member 406 and the second stop member 408 is at least partially disposed in a corresponding bore formed in the jaw carrier 212.

Figure 9:
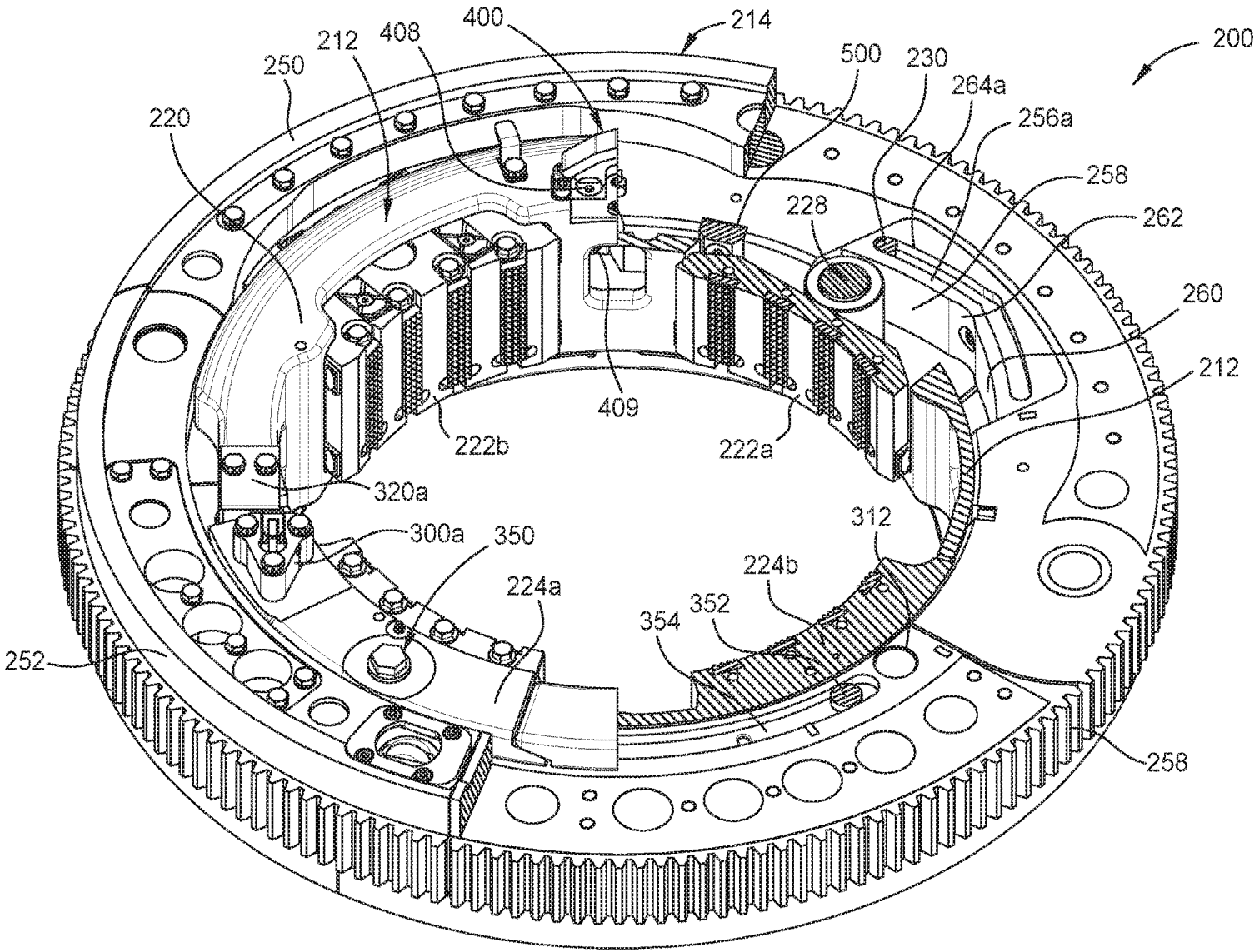
FIG. 9 is a partial cross-sectional view of the rotary griping apparatus 200 illustrating the active jaws 222*a,b* in a radially extended position.

The make/break switch 400 has two configurations. The first configuration is shown in FIGS. 6A, 6B and the second configuration is shown in FIGS. 6C, 9. In the first configuration, the switch member 410 is tilted toward the first stop member 406. The end 407 of the first stop member 406 is disposed below the end 409 of the second stop member 408. In the second configuration, the switch member 410 is tilted toward the second stop member 408. The end 409 of the second stop member 408 is disposed below the end 407 of the first stop member 406. The make/break switch 400 is movable between the first configuration and the second configuration, and vice versa. In some embodiments, the switch member 410 is engaged with a surface 403 of the body 402. The make/break switch 400 can be moved between configurations manually, or in response to a pneumatic, hydraulic, or electrical actuator.

FIG. 6B illustrates a stop key 500 attached to the cam body 214. In this embodiment, the stop key 500 is attached to the cam base 250. The stop key 500 can be attached to the cam body 214 by a fastener, or the stop key 500 can be an integral component of the cam body 214, such as an integral component of the cam base 250. The stop key 500 is configured to be engaged by the first stop member 406 when the make/break switch 400 is in the first configuration or the second stop member 408 when the make/break switch 400 is in the second configuration. For example, the stop key 500 may be disposed at an equidistant location between cams 256*a,b*, such as an equidistant location between the respective third cam faces 262 of cams 256*a,b*.

When the make/break switch 400 is in the first configuration, the cam body 214 is prevented from rotating relative to the jaw carrier 212 in the clockwise direction to radially extend the active jaws 222 because the stop key 500 will engage the first stop member 406. However, the cam body 214 is rotatable in the counter-clockwise direction relative to the jaw carrier 212 to radially extend the active jaws 222. When the make/break switch 400 is in the second configuration, the cam body 214 is prevented from rotating relative to the jaw carrier 212 in the counter-clockwise direction to radially extend the active jaws 222 because the stop key 500 will engage the second stop member 408. However, the cam body 214 is rotatable in the clockwise direction relative to the jaw carrier 212 to radially extend the active jaws 222. Thus, the make/break switch 400 and stop key 500 controls which direction the cam body 214 can rotate relative to the jaw carrier 212 to extend the active jaws 222.

The make/break switch 400 and stop key 500 limit the amount of rotation of the cam body 214 relative to the jaw carrier 212 when the cam body 214 is rotated to retract the active jaws 222. When the make/break switch 400 is in the first configuration, the stop key 500 will limit the amount of clockwise rotation of the cam body 214 relative to the jaw carrier 212 when retracting the active jaws 222 from the radially extended position. After the stop key 500 engages the first stop member 406, the rotary gripping apparatus 200 is in a neutral alignment, and the rotary gripping apparatus 200 can be opened. When the make/break switch 400 is in the second configuration, the stop key 500 will limit the amount of counter-clockwise rotation of the cam body 214 relative to the jaw carrier 212 when retracting the active jaws 222 from the radially extended position. After the stop key 500 engages the second stop member 408, then the rotary gripping apparatus 200 is in a neutral alignment and the rotary gripping apparatus 200 can be opened.

To open or close the rotary gripping apparatus 200, the jaw carrier 212 and cam body 214 should be in the neutral alignment shown in FIG. 2A. In this embodiment, when in the neutral alignment, the active jaw portion 220 of the jaw carrier 212 is aligned with cam base 250. As shown in FIG. 2A, when in the neutral alignment, the first passive jaw assembly 242*a* is aligned with the first cam arm 252 such that the bore 310 of the first passive jaw assembly 242*a* is aligned with the recess 312 of the first cam arm 252. The alignment of the bore 310 with the recess 312 facilitates the locking member 304 of the lock 300*a* moving into the recess 312 when the first cam arm 252 and first passive jaw assembly 242*a* (e.g. the first rotary arm 206) move from the closed position to the open position. Similarly, when in the neutral alignment, the second passive jaw assembly 242*b* is aligned with the second cam arm 254 such that the bore 310 of the second passive jaw assembly 242*b* is aligned with the recess 312 of the second cam arm 254. The alignment of the bore 310 with the recess 312 facilitates the locking member 304 of the lock 300*b* moving into the recess 312 when the second cam arm 254 and second passive jaw assembly 242*b* (e.g. the second rotary arm 208) moves from the closed position to the open position. If the rotary gripping apparatus 200 is not in the neutral alignment, then the jaw carrier 212 and cam body 214 will be misaligned, which prevents the rotary gripping apparatus 200 from converting from the closed configuration to the open configuration.

Figure 7C:
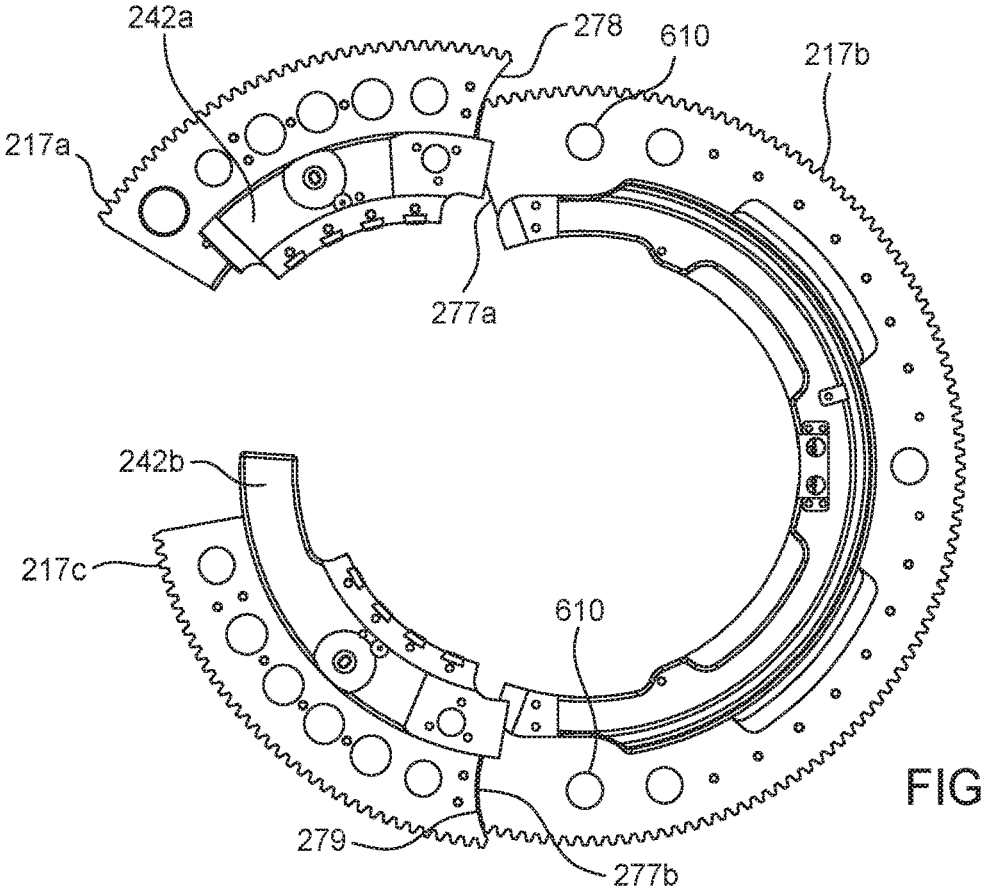
Figure 7D:
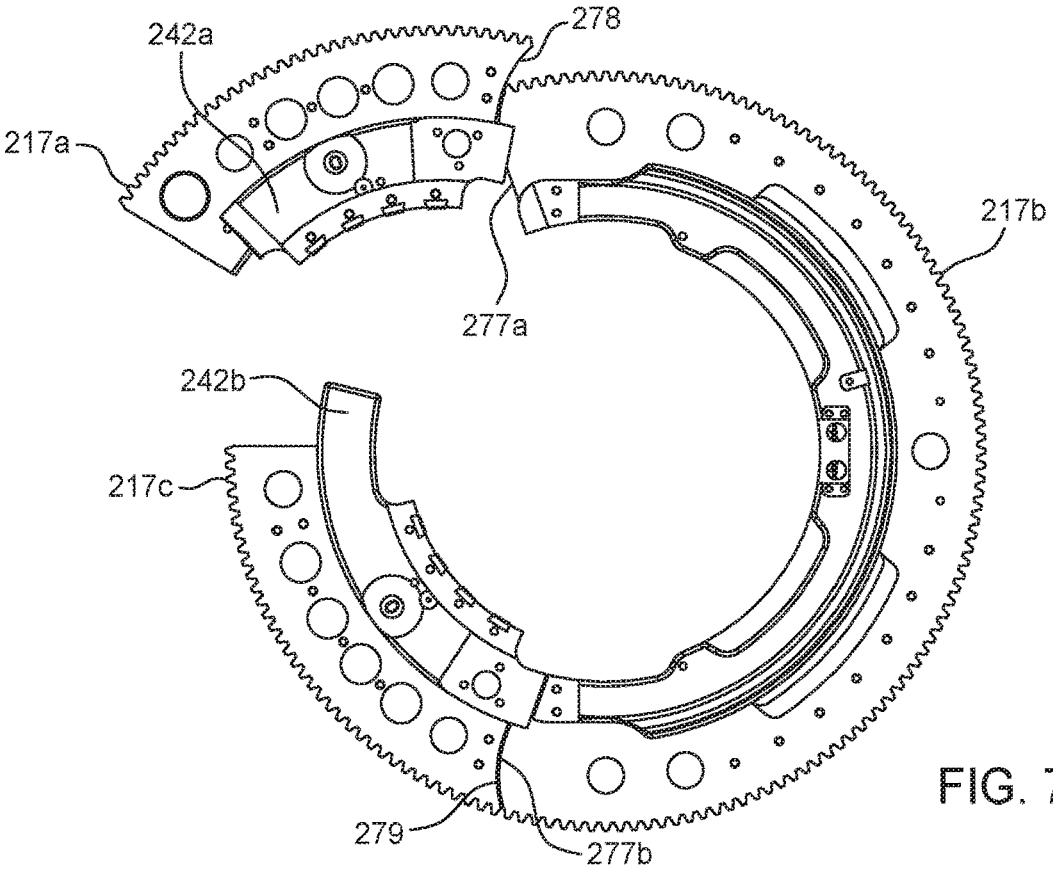

FIGS. 7A-7D and 8A-8C illustrate the rotary gripping apparatus 200 without the first body member 216, the second body member 218, the active jaws 222, the alignment assembly 350, the make/break switch 400, and the stop key 500 to better illustrate the movement of the passive jaw assemblies 242*a, b* relative to the active jaw portion 220 of the jaw carrier 212. FIG. 7B is a top view of FIG. 7A and shows the position of the first arm segment 217*a* and the second arm segment 217*c* when the rotary gripping apparatus 200 is in an open configuration having both the first and second rotary arms 206, 208 in the open position. FIG. 7C shows the position of first arm segment 217*a* in the open position and the position of the second arm segment 217*c* in an intermediate position between the closed and open positions. FIG. 7C also shows the bores 610 in the base segment 217*b* that the pivot pins 251 are partially disposed in to allow the first rotary arm 206 and second rotary arm 208 to pivot relative to the rotary base 204. FIG. 7D illustrates the rotary gripping apparatus 200 in the open configuration, showing the position of the first arm segment 217*a* when the first rotary arm 206 is in the open position and the position of the second arm segment 217*c* after the second rotary arm 208 has returned to, or remained in, the closed position.

Figure 8A:
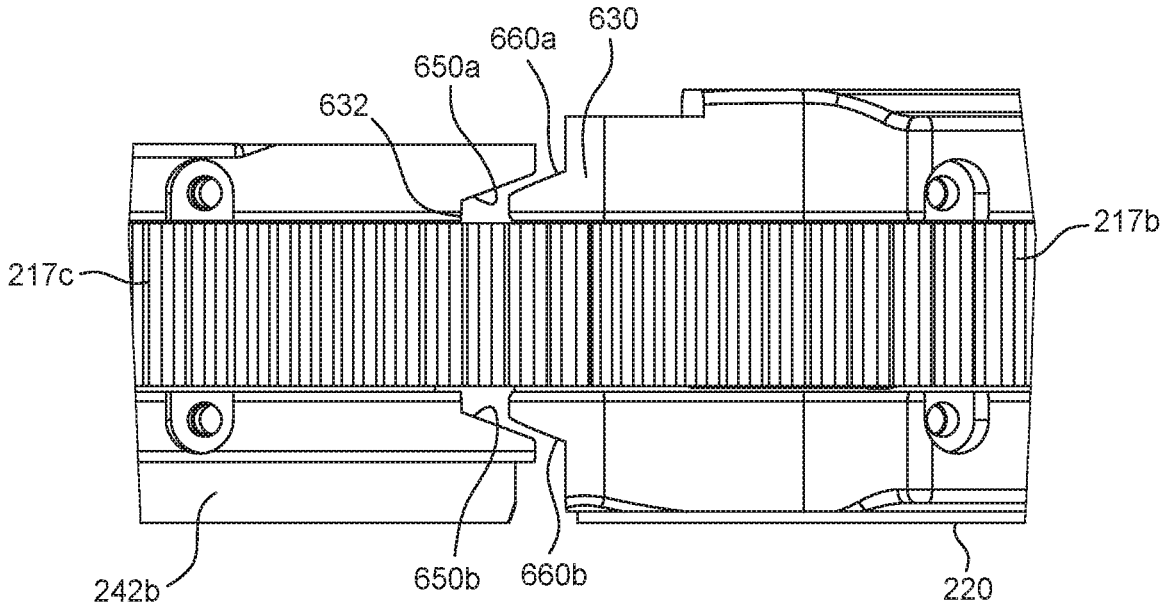
Figure 8B:
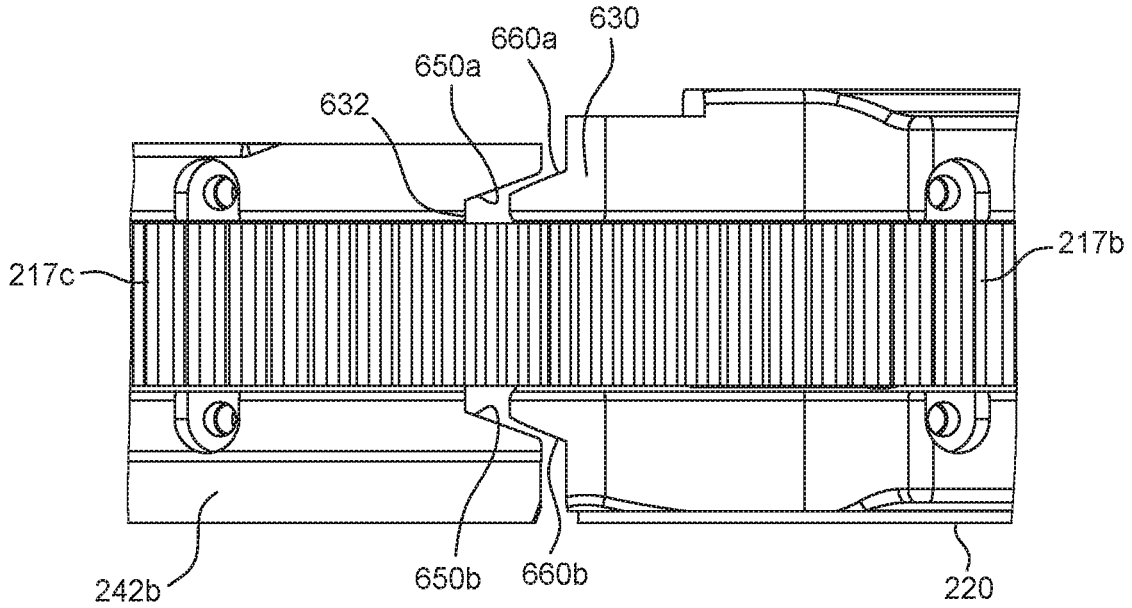
Figure 8C:
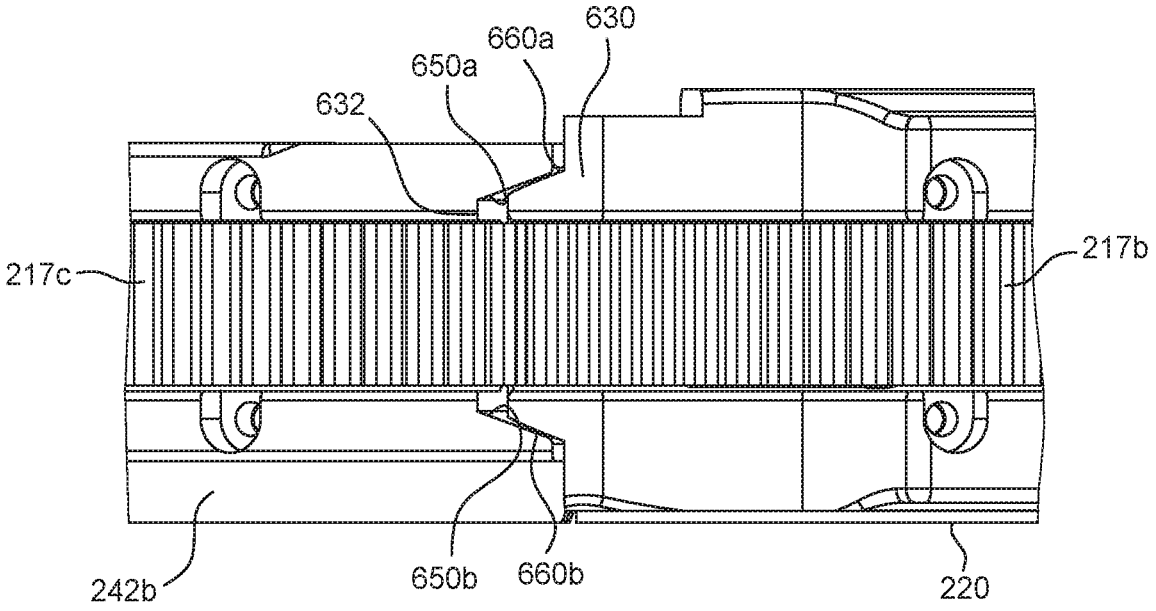

Each passive jaw assembly 242 will have surfaces 650 corresponding to complementary surfaces 660 of the active jaw portion 220 such that the active jaw portion 220 and passive jaw assembly 242 are vertically aligned and engaged when in the closed configuration or when either rotary arm 206, 208 is in the closed position. The surfaces 650 of the passive jaw assembly 242 may be part of a recess 632 configured to receive a protrusion 630 of the active jaw portion 220. The surfaces 660 of the active jaw portion 220 may be disposed on the protrusion 630. FIGS. 8A-8C illustrate the surfaces 650 of the second passive jaw assembly 242*b* corresponding to the complementary surfaces 660 at one end of the active jaw portion 220.

FIG. 8A is a partial side view of FIG. 7B. FIG. 8B is a partial side view of FIG. 7C. FIG. 8C is a partial side view of FIG. 7D. In the illustrated embodiment, the surfaces 650 of the passive jaw assemblies 242*a,b* are an upper surface 650*a* and a lower surface 650*b* of the recess 632. In the illustrated embodiment, the surfaces 660 of the active jaw portion 220 are an upper surface 660*a* and a lower surface 660*b* of the protrusion 630. The upper surface 650*a* is configured to engage the upper surface 660*a*, and the lower surface 650*b* is configured to engage the lower surface 660*b* when the recess 632 receives the protrusion 630 when the respective rotary arm 206, 208 is in the closed position. As shown in FIG. 8A, the surfaces 650*a,b* are disengaged with surfaces 660*a,b* when the second rotary arm 208 is in the open position. As shown in FIG. 8C, the surfaces 650*a,b* are engaged with surfaces 660*a,b* when the second rotary arm 208 is in the closed position. The engagement of the surfaces 650*a,b* with surfaces 660*a,b* vertically aligns the second passive jaw assembly 242*b* with the active jaw portion 220 such that the rotary gripping apparatus 200 can be rotated by the drive gear, including aligning the gear teeth 217*t* of the differing individual segments of the gear member 217.

An exemplary brake 280 of the jaw carrier 212 is illustrated in FIG. 2C. The brake 280 has a plurality of brake pads 281. The brake 280 has a first arm segment 282, a second arm segment 284, and a base segment 286. The base segment 286 is attached to or integral with the active jaw portion 220. The first arm segment 282 is attached to or integral with the first passive jaw assembly 242*a*. The second arm segment 284 is attached to or integral with the second passive jaw assembly 242*b*. When the first cam arm 252 and first passive jaw assembly 242*a* are locked together by the lock 300*a* to form the first rotary arm 206, the first rotary arm 206 will also include the first arm segment 282 of the brake 280. When the second cam arm 254 and the second passive jaw assembly 242*b* are locked together by the lock 300*b* to form the second rotary arm 208, the second rotary arm 208 will also include the second arm segment 284 of the brake 280. When in the neutral alignment, the rotary base 204 includes the base segment 286. When the rotary gripping apparatus 200 is in the closed configuration, the brake 280 forms an enclosed ring that can be engaged with the brake band 142 to slow or stop the rotation of the rotary gripping apparatus 200 and/or to hold the jaw carrier 212 in a fixed position relative to the cam body 214.

For example, to rotate the cam body 214 relative to the jaw carrier 212 to radially extend the active jaws 222*a,b*, the brake band assembly 140 engages the brake 280 to hold the jaw carrier 212 in a fixed position relative to the cam body 214, thereby preventing the jaw carrier 212 from rotating. While the brake band assembly 140 applies a brake force to the brake 280 to hold the jaw carrier in the fixed position, the cam body 214 can rotate relative to the jaw carrier 212 in a first direction to extend the active jaws 222*a,b*. The cam body 214 is rotated relative to the jaw carrier 212 by the drive gear of the power tong 110 until the cam body 214 becomes rotationally locked with the jaw carrier 212. Once the cam body 214 becomes rotationally locked with the jaw carrier 212, the force applied by the drive gear to the cam body 214 is transferred to the jaw carrier 212. When the rotational force applied by the drive gear to the cam body 214 exceeds the break force applied by the brake band 142 to the brake 280, the entire rotary gripping apparatus 200 will be rotated by the drive gear of the power tong 110. The brake band 142 is then disengaged from the brake 280 after rotation has begun, such as by actuating the first and second actuators 144*a,b*. The entire rotary gripping apparatus 200 is rotated to make-up or break-out a tubular gripped by the passive jaws 244 and the active jaws 222. In some embodiments, the brake band assembly 140 can be automated such that the brake band 142 automatically releases the brake 280 upon the full extension of the active jaws 222 to prevent excess wear on the brake pads 281. Automatically releasing the brake 280 may limit the period of contact of the rotating brake 280 with the brake band 142. In some embodiments, the brake band 142 may be re-engaged with the brake 280 during the make-up or break-out operation to control the rotational speed of the rotary gripping apparatus 200.

In another example, the active jaws 222 may be retracted by engaging the brake band assembly 140 with the brake 280 to prevent rotation of the jaw carrier 212 and rotating the cam body 214 relative to the jaw carrier 212 in the opposite direction until the neutral alignment is reached. The brake band assembly 140 can be disengaged from the brake 280 once the neutral alignment is reached.

FIG. 9 illustrates the active jaws 222 in the radially extended position after the cam body 214 has been rotated clockwise relative to the jaw carrier 212. The make/break switch 400 is shown to be in the second configuration. As shown, the roller assembly 228 is engaged with the wall 255 and the first cam face 258. The follower member 230 has moved to one end of the slot 264*b*. The alignment member 352 of the second passive jaw assembly 242*b* is shown disposed in the slot 354 of the second cam arm 254.

Figure 10A:
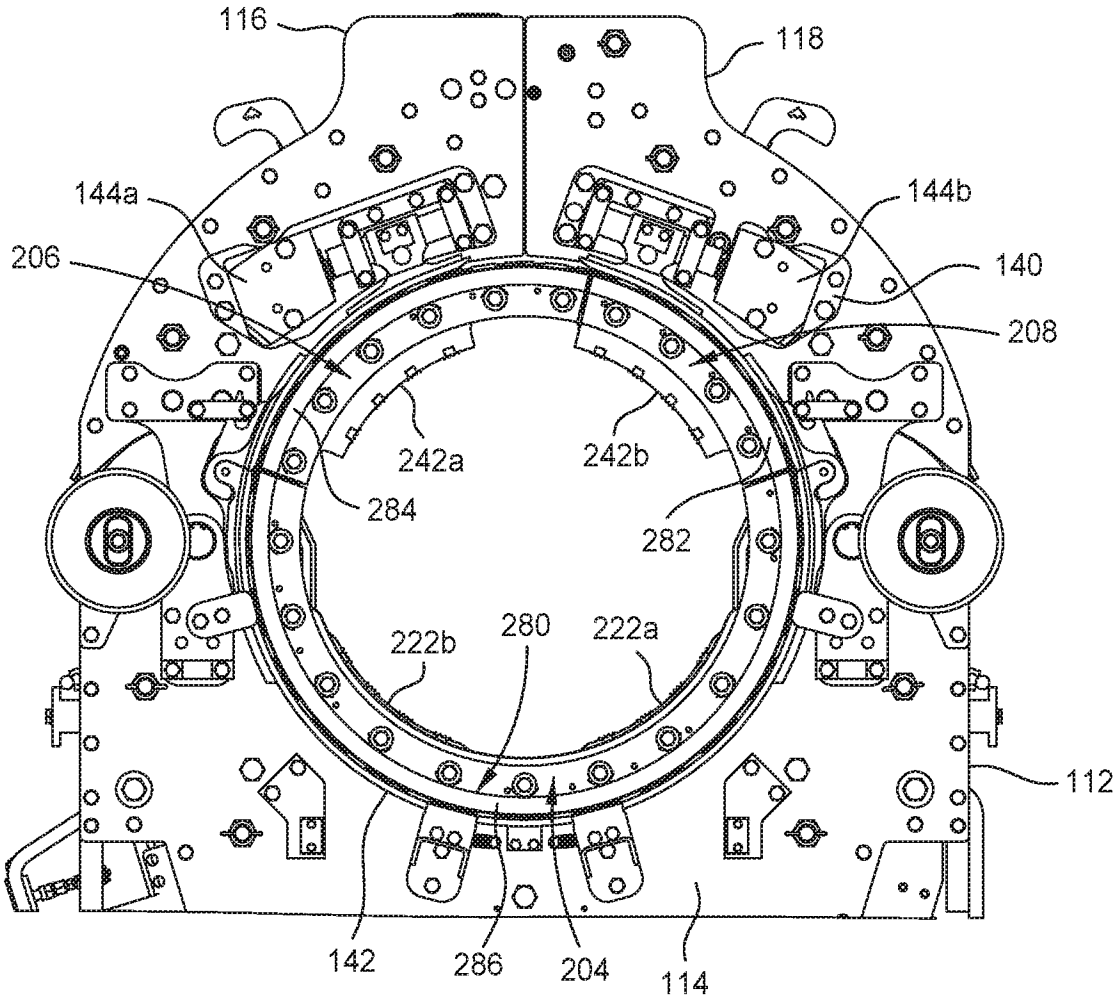
FIG. 10A illustrates an underside of the power tong 110.
Figure 10B:
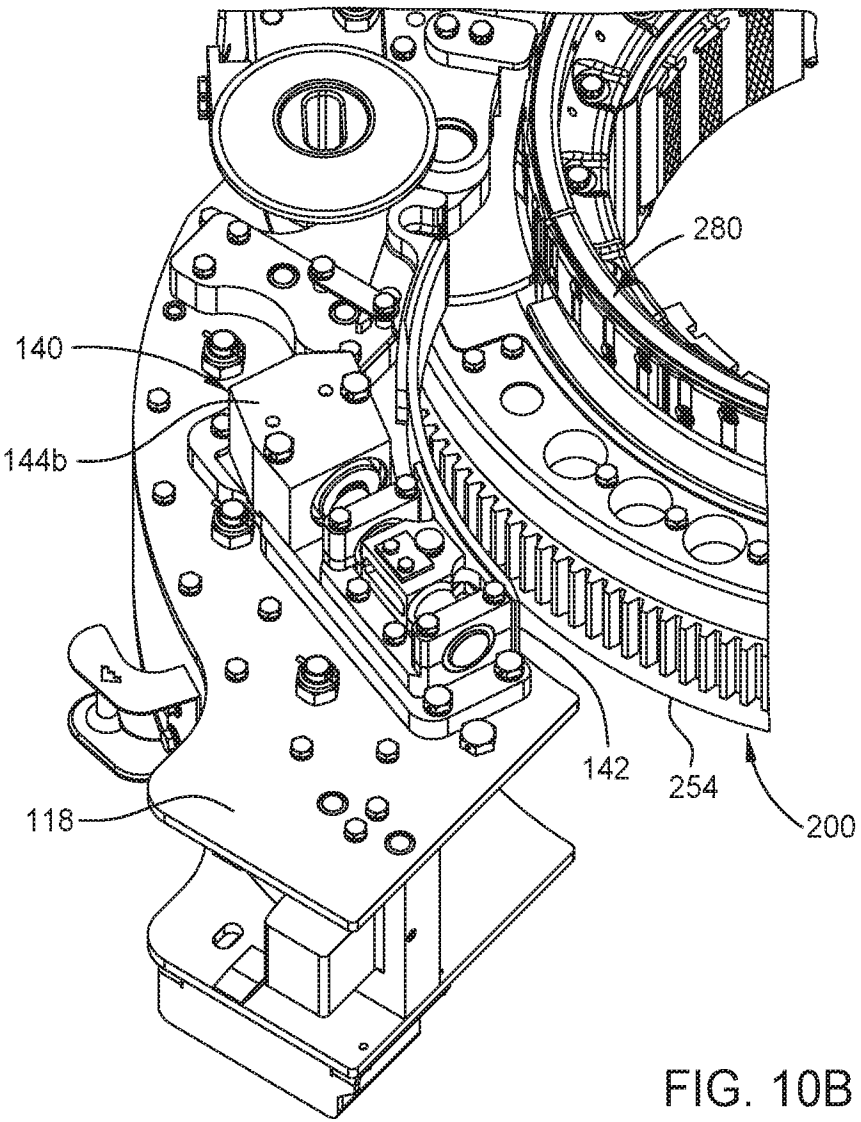
FIG. 10B illustrates a partial view of the power tong 110 showing the second body arm 118 withdrawn away from the rotary gripping apparatus 200.

FIG. 10 illustrates an underside of one embodiment of the power tong 110 with the rotary gripping apparatus 200 disposed therein. FIGS. 1 and 10A illustrate the first body arm 116, the second body arm 118, and the brake band assembly 140 of the power tong 110. FIG. 10B illustrates a partial view of the power tong 110 showing the second body arm 118 withdrawn away from the rotary gripping apparatus 200 to better illustrate the body arms of the power tong 110. In some embodiments, the first body arm 116 is configured to selectively grip the first rotary arm 206 and move the first rotary arm 206 between the closed position and the open position. In some embodiments, the second body arm 118 is configured to selectively grip the second rotary arm 208 and move the second rotary arm 208 between the closed positon and the open position. Before the first and second body arms 116, 118 grip the rotary arms 206, 208, the rotary gripping apparatus 200 is placed in the neutral alignment and then rotated to a neutral orientation with respect to the tong body 112 as shown in FIG. 10A. For example, when the rotary gripping apparatus 200 is in the neutral orientation, the first and second body arms 116, 118 are aligned with the respective rotary arms 206, 208. Thus, the first and second body arms 116, 118 can grip and move the respective rotary arms 206, 208 when in the neutral orientation. The first and second body arms 116, 118 are moved by an actuator. When the first and second body arms 116, 118 are not gripping the respective rotary arm 206, 208 of the rotary gripping apparatus 200, the rotary gripping apparatus 200 is rotatable relative to the other components of the power tong 110. In some embodiments, the base body 114 may be configured to selectively grip the rotary base 204 to keep it from moving when the rotary arms 206, 208 are moved. The first and second body arms 116, 118 may selectively grip the respective rotary arms 206, 208 by a plurality of pins attached to the tong body 112 that can be actuated to interface with a plurality of receptacles attached to, or formed within, the respective rotary arms 206, 208. The base body 114 may selectively grip the rotary base 204 by a plurality of pins attached to the tong body 112 that can be actuated to interface with a plurality of receptacles attached to, or formed within, the rotary base 204.

Figures 11A, 11B:
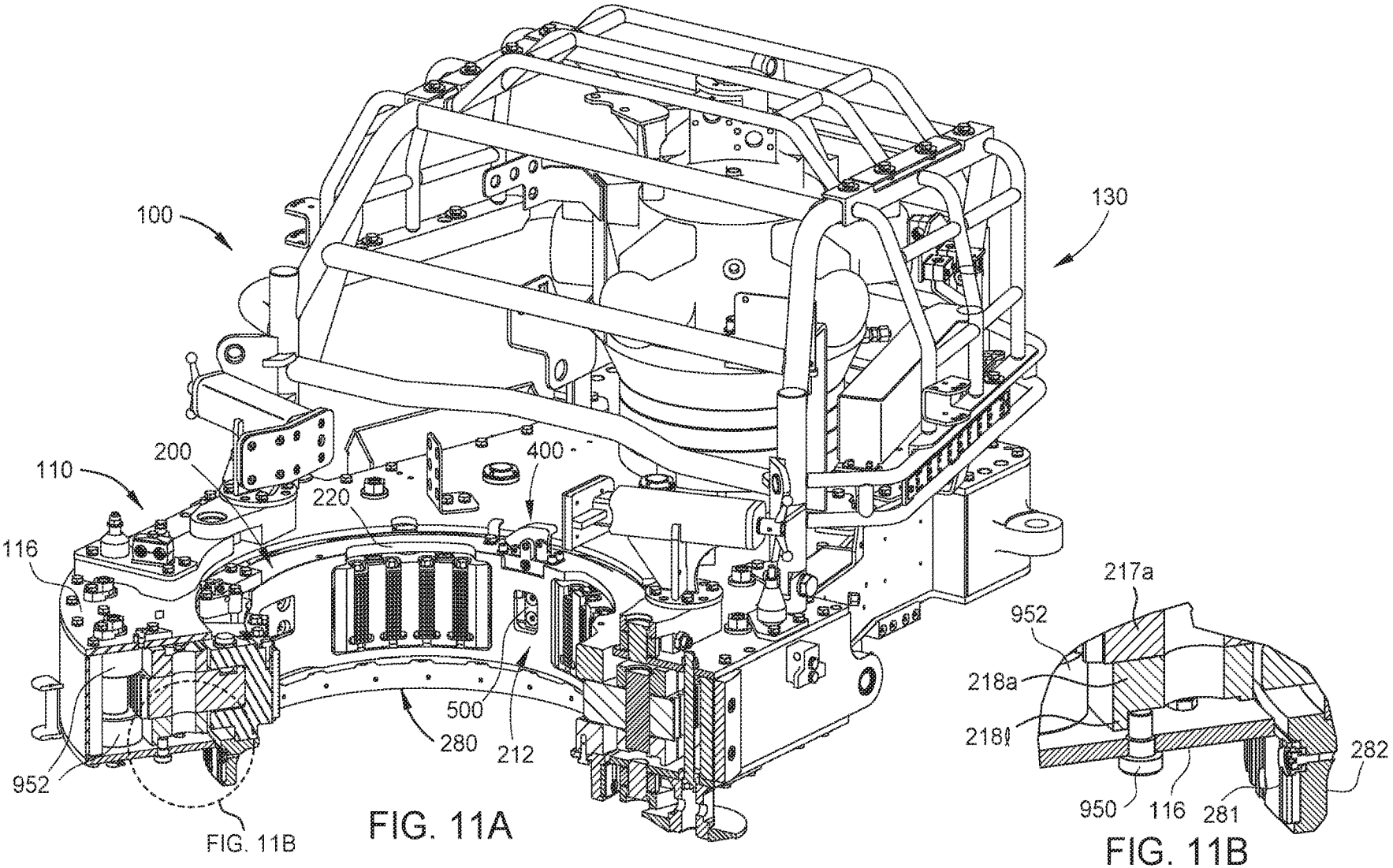
FIG. 11A is a partial cross sectional view of the tong assembly 100.
FIG. 11B is an enhanced view of FIG. 11A.

FIG. 11A is a partial cross section of one embodiment of the tong assembly 100. FIG. 11B illustrates a close-up view of a portion of FIG. 11A. As shown in FIG. 11B, rollers 950 engage a lip 2181 of the second body member 218 and rollers 952 engage a surface of the first body member 216 and second body member 218. The rollers 952 are disposed in the first and second body arms 116, 118. The rollers 950, 952 facilitate the rotation of the rotary gripping apparatus 200 relative to the tong body 112. Instead of, or in addition to, the first body arm 116 and the second body arm 118 being able to selectively grip the respective first and second rotary arm 206, 208, the first and second body arms 116, 118 include the one or more rollers 950. The engagement of the rollers 950 with the lip 2181 allows the first and second body arms 116, 118 to move the respective first and second rotary arms 206, 208 to the open position. The rollers 952 additionally facilitate the closing of the rotary gripping apparatus 200 by pushing against the rotary arms 206, 208 as the first and second body arms 116,118 close. In some embodiments, a retaining bolt can be used in lieu of or in addition to the rollers 950 to engage the lip 218*l*.

In some embodiments, the tong assembly 100 is used in a make-up operation. First, the rotary gripping apparatus 200 is positioned in the neutral alignment and in the neutral orientation. Then, the rotary gripping apparatus 200 is opened to create the gap 210 by moving first body arm 116 and the second body arm 118 to the open position, which moves the first rotary arm 206 and second rotary arm 208 to the open position. A tubular is then inserted into the gap 210. After centering the tubular in the rotary gripping apparatus 200, or during the centering process, the rotary gripping apparatus 200 can be closed by closing the first and second body arms 116, 118 of the power tong 110, which closes the respective first and second rotary arm 206, 208 to close the gap 210. Then, the brake band assembly 140 moves the brake band 142 into engagement with the brake 280 to hold the jaw carrier 212 in a fixed position relative to the cam body 214. The drive gear of the power tong 110 rotates the cam body 214 in a first direction relative to jaw carrier 212 until the active jaws 222 extend into engagement with the tubular and the cam body 214 becomes rotationally locked with jaw carrier 212. When the force applied by the drive gear exceeds the brake force applied by the brake band assembly 140 to the brake 280, the entire rotary gripping apparatus 200 is able to rotate relative to the other components of the power tong 110. With the tubular gripped by the jaws 222, 244, the rotary gripping apparatus 200 is then rotated until make-up of the tubular is complete. Once make-up of the tubular is complete, the brake band assembly 140 re-engages the brake 280 to hold the jaw carrier 212 in a fixed position relative to the cam body 214. The drive gear of the power tong 110 rotates the cam body 214 in the opposite direction relative to the jaw carrier 212 to release the tubular from the jaws 222, 244 until the neutral alignment is reached. The tubular is released from the jaws 222, 244 because the active jaws 222 have disengaged from the tubular. Then, the brake band assembly 140 may release the brake 280 allowing the drive gear to rotate the rotary gripping apparatus 200 to the neutral orientation with respect to the tong body 112 of the power tong 110. Then the first and second body arms 116, 118 are opened to open the rotary arms 206, 208 to form the gap 210. The tubular may then be removed from the rotary gripping apparatus 200 via the gap 210. The process is repeated as necessary to make-up multiple joints of tubular.

In some embodiments, the tong assembly 100 is used in a break-out operation. First, the rotary gripping apparatus 200 is positioned in the neutral alignment and in the neutral orientation. Then, the rotary gripping apparatus 200 is opened to create the gap 210 by moving the first body arm 116 and second body arm 118 to the opened position, which moves the first rotary arm 206 and the second body arm 118 to the open position. A tubular for the break-out operation is then inserted into the gap 210. After centering the tubular in the rotary gripping apparatus 200, or during the centering process, the rotary gripping apparatus 200 is closed by closing the first and second body arms 116, 118, which also closes the respective first and second rotary arm 206, 208 to close the gap 210. Then, the brake band assembly 140 moves the brake band 142 into engagement with the brake 280 to hold the jaw carrier 212 in a fixed position relative to the cam body 214. The drive gear of the power tong 110 rotates the cam body 214 in a first direction relative to jaw carrier 212 until the active jaws 222 extend into engagement with the tubular and the cam body 214 becomes rotationally locked with the jaw carrier 212. When the force applied by the drive gear exceeds the brake force applied by the brake band assembly 140 to the brake 280, the entire rotary gripping apparatus 200 is able to rotate relative to the other components of the power tong 110. With the tubular gripped by the jaws 222, 244, the rotary gripping apparatus 200 is then rotated until break-out of the tubular is complete. Once break-out of the tubular is complete, the brake band assembly 140 re-engages the brake 280 to hold the jaw carrier 212 in a fixed position relative to the cam body 214. The drive gear of the power tong 110 rotates the cam body 214 relative to the jaw carrier 212 to release the tubular from the jaws 222, 244 until the neutral alignment is reached. The tubular is released from the jaws 222, 244 because the active jaws 222 have disengaged from the tubular. Then, the brake band assembly 140 may release the brake 280 allowing the drive gear to rotate the rotary gripping apparatus 200 to the neutral orientation with respect to the tong body 112. Then the first and second body arms 116, 118 are opened to open the rotary arms 206, 208 to form the gap 210. The tubular may then be removed from the rotary gripping apparatus 200 via the gap 210. The process is repeated as necessary to break-out multiple joints of tubular.

In some embodiments, the first rotary arm 206 and second rotary arm 208 may be moved together, or one rotary arm may be moved to the open position prior to the other rotary arm. In some embodiments, only one of the first and second rotary arms 206, 208 is opened to form the gap 210.

Figure 12:
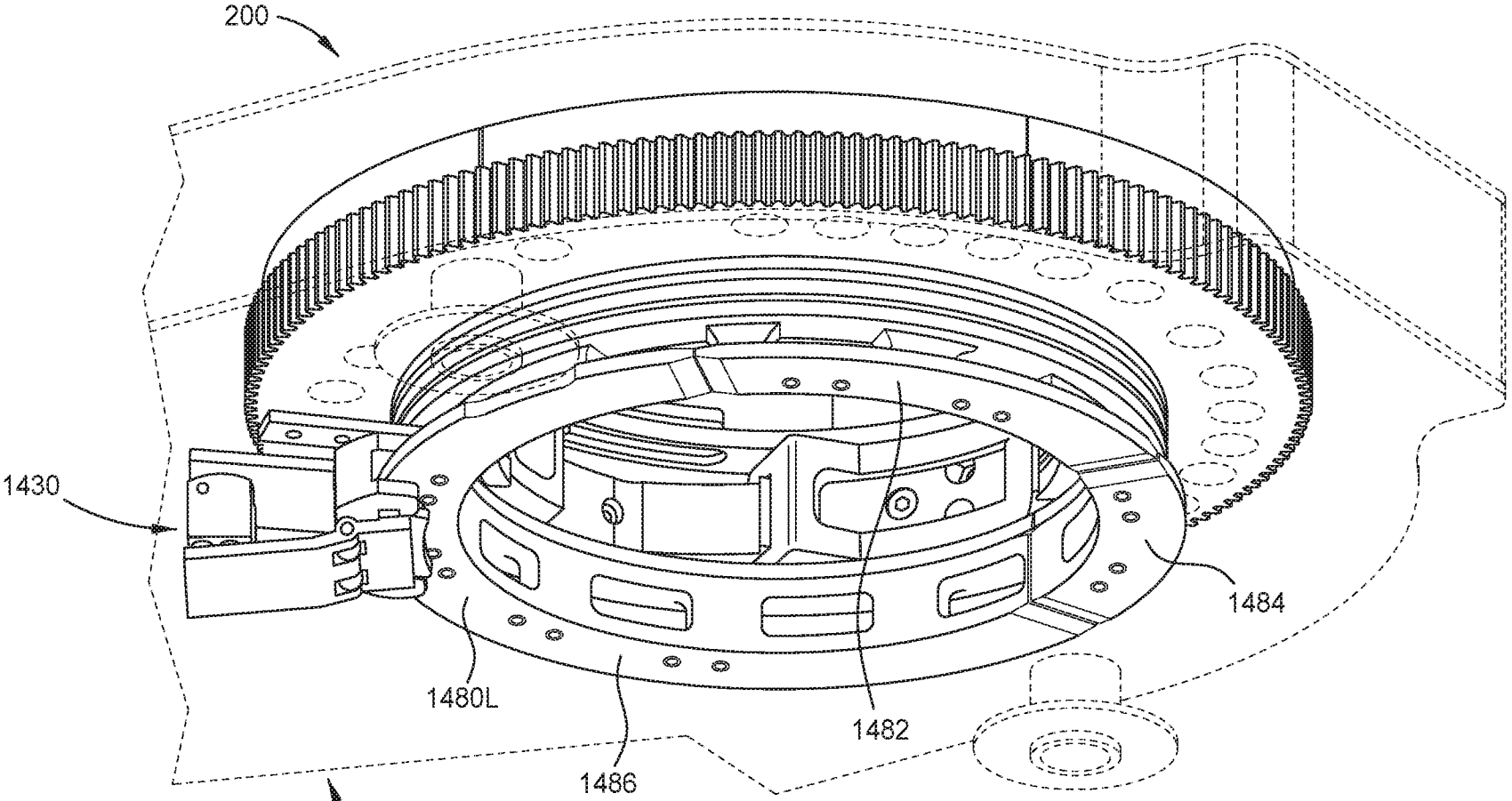
FIG. 12 illustrate another embodiment of a brake assembly.
Figure 13:
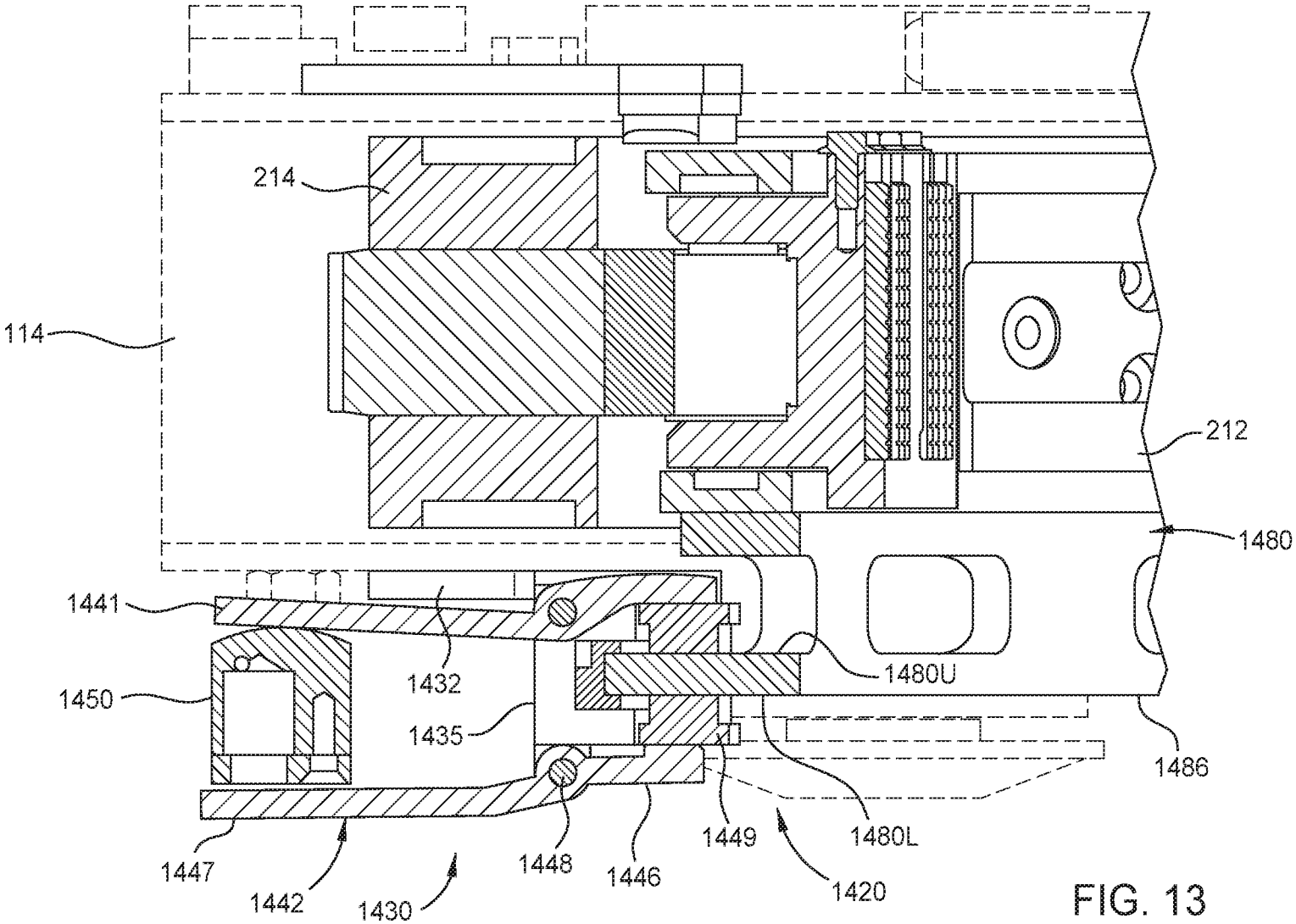
FIG. 13 is an enlarged, partial view of the brake assembly of FIG. 12.

FIGS. 12 and 13 illustrate another embodiment of a brake assembly 1420. FIG. 12 is a perspective view of the brake assembly 1420 attached to the rotary gripping apparatus 200. FIG. 13 is an enlarged, partial view of the brake assembly 1420. The brake assembly 1420 includes a brake device 1430 and a brake rotor 1480. In this embodiment, the brake rotor 1480 is attached to the bottom of the jaw carrier 212. The brake rotor 1480 has a first rotor segment 1482, a second rotor segment 1484, and a base rotor segment 1486. These rotor segments 1482, 1484, 1486 form a ring when the rotary gripping apparatus is in the closed configuration. The rotor segments 1482, 1484, 1486 include an upper surface 1480U and a lower surface 1480L for engagement with the brake device 1430. In this example, the upper and lower surfaces 1480U, 1480L are radially extending surfaces that face axially. In some examples, upper and lower surfaces 1480U, 1480L may be oriented differently, and in some examples, may be described as inner and outer surfaces. The base rotor segment 1486 is attached to or integral with the active jaw portion 220 of the jaw carrier 212. The first rotor segment 1482 is attached to or integral with the first passive jaw assembly 242*a*. The second rotor segment 1484 is attached to or integral with the second passive jaw assembly 242*b*. When the rotary gear 217*c*, 217*a* and passive jaw assemblies 242*a*, 242*b* are locked together by the locks 300*a*, 300*b* to form the respective rotary arms 206, 208, the rotary arms 206, 208 will also include the rotor segments 1482, 1484 of the brake rotor 1480. When in the neutral alignment, the rotary base 204 includes the base rotor segment 1486. In some embodiments, all of the jaws are active jaws.

In some embodiments, the brake rotor 1480 is a C-shaped profile such that the brake device 1430 can grip a lower "lip" of the C-shaped profile. In one example, the "lip" has a flat configuration. The upper lip can be attached to the jaw carrier 212. In this example, the lower lip extends radially outward more than the upper lip. However, the lower lip can have the same or shorter radial length than the upper lip. In this example, the lower lip includes the upper surface 1480U and the lower surface 1480L. The brake device 1430 can engage the brake rotor 1480 to slow or stop the rotation of the rotary gripping apparatus 200 and/or to hold the jaw carrier 212 in a fixed position relative to the cam body 214.

In some embodiments, the brake device 1430 includes a frame 1435, a first brake member, a second brake member, and an actuator 1450. The brake device 1430 may include a mounting bracket 1432 for attachment to the base body 114 of the tong body 112. The mounting bracket 1432 is connected to the frame 1435. In some embodiments, the first and second brake members are first and second brake arms 1441, 1442 that are pivotally connected to the frame 1435. Each brake arm 1441, 1442 includes an engagement portion 1446 and a lever portion 1447. The brake arms 1441, 1442 are arranged such that the rotor 1430 is disposed between the engagement portions 1446, and the actuator 1450 is disposed between the lever portions 1147. In this example, the length of the lever portions 1447, as measured from the pivot point 1448, is longer than the length of the engagement portions 1446. However, it is contemplated the length of the lever portions 1447 can be the same or shorter than the length of the engagement portion 1446. In some embodiments, the engagement portions 1446 can include brake pads 1449 to facilitate engagement with the brake rotor 1480. The brake pads 1449 may be detachable from the brake arms 1441, 1442 to facilitate replacement when worn. The actuator 1450 is configured to move the engagement portions 1446 into and out of engagement with the brake rotor 1480. An exemplary actuator 1450 is a piston and cylinder assembly. In this example, the piston can be extended to move the lever portions 1447 apart, thereby pivoting the engagement portions 1446 into engagement with the brake rotor 1480. In another embodiment, a brake caliper is used to stop or control rotation of the brake rotor 1480. The brake caliper includes two plates that can be compressed against the brake rotor 1480 by a piston and cylinder assembly. The plates can include brake pads for engaging the brake rotor 1480. The piston and cylinder assembly is positioned on one side of the brake rotor 1480 with one of the plates. When the piston and cylinder assembly is extended, the plate on the same side as the piston and cylinder assembly is pushed toward the brake rotor 1480, and the plate on the other side of the brake rotor 1480 is pulled toward the brake rotor 1480.

In operation, the brake device 1430 engages the brake rotor 1480 to hold the jaw carrier 212 in a fixed position relative to the cam body 214, thereby preventing the jaw carrier 212 from rotating. The actuator piston 1450 is extended to pivot the engagement portions 1146 to a closed position to retain the brake rotor 1480. Then, the cam body 214 is rotated relative to the jaw carrier 212 in a first direction to extend the active jaws 222*a,b*. The cam body 214 is rotated by the drive gear of the power tong 110 until the cam body 214 becomes rotationally locked with the jaw carrier 212. After reaching the rotationally locked position, the force applied by the drive gear to the cam body 214 is transferred to the jaw carrier 212. When the rotational force applied to the cam body 214 exceeds the brake force applied by the brake device 1430 to the brake rotor 1480, the entire rotary gripping apparatus 200 will be rotated by the drive gear of the power tong 110. The brake device 1430 is then disengaged from the brake rotor 1480. In this respect, the actuator piston 1450 is retracted to pivot the engagement portions 1446 to an open position. The entire rotary gripping apparatus 200 is rotated to make-up or break-out a tubular gripped by the passive jaws 244 and the active jaws 222. In some embodiments, the brake device 1430 can be automated such that the engagement portion 1446 automatically releases the brake rotor 1480 upon the full extension of the active jaws 222 to prevent excess wear on the brake pads 1449. In some embodiments, the brake device 1430 may re-engage with the brake rotor 1480 during the make-up or break-out operations to control the rotational speed of the rotary gripping apparatus 200.

In another example, the active jaws 222 may be retracted by first engaging the brake device 1430 with the brake rotor 1480 to prevent rotation of the jaw carrier 212 and then rotating the cam body 214 relative to the jaw carrier 212 in the opposite direction until the neutral alignment is reached. The brake device 1430 can be disengaged from the brake rotor 1480 once the neutral alignment is reached.

Figure 14:
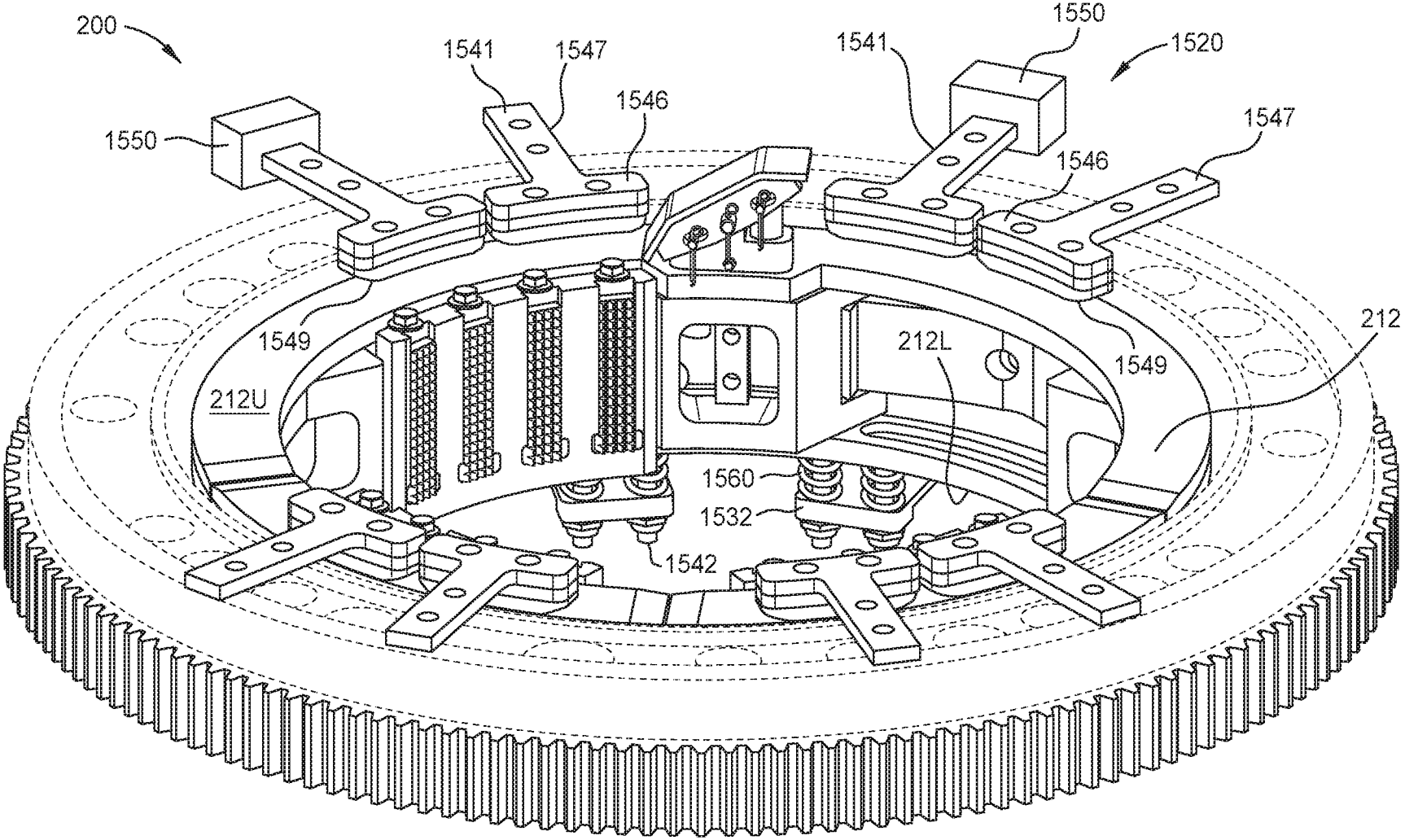
FIG. 14 illustrate yet another embodiment of a brake assembly.
Figure 15:
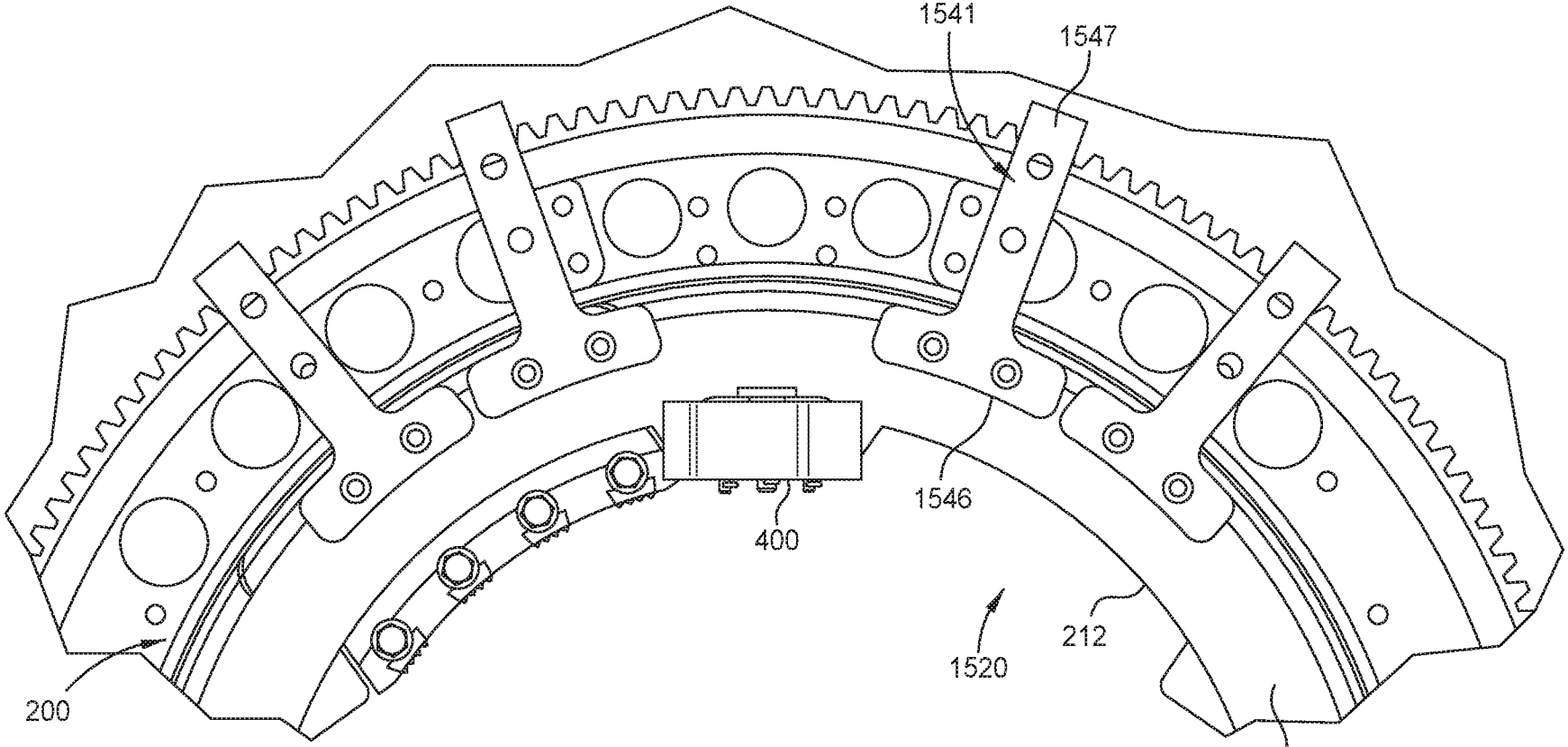
FIG. 15 is an enlarged, partial top view of the brake assembly of FIG. 14.
Figure 16:
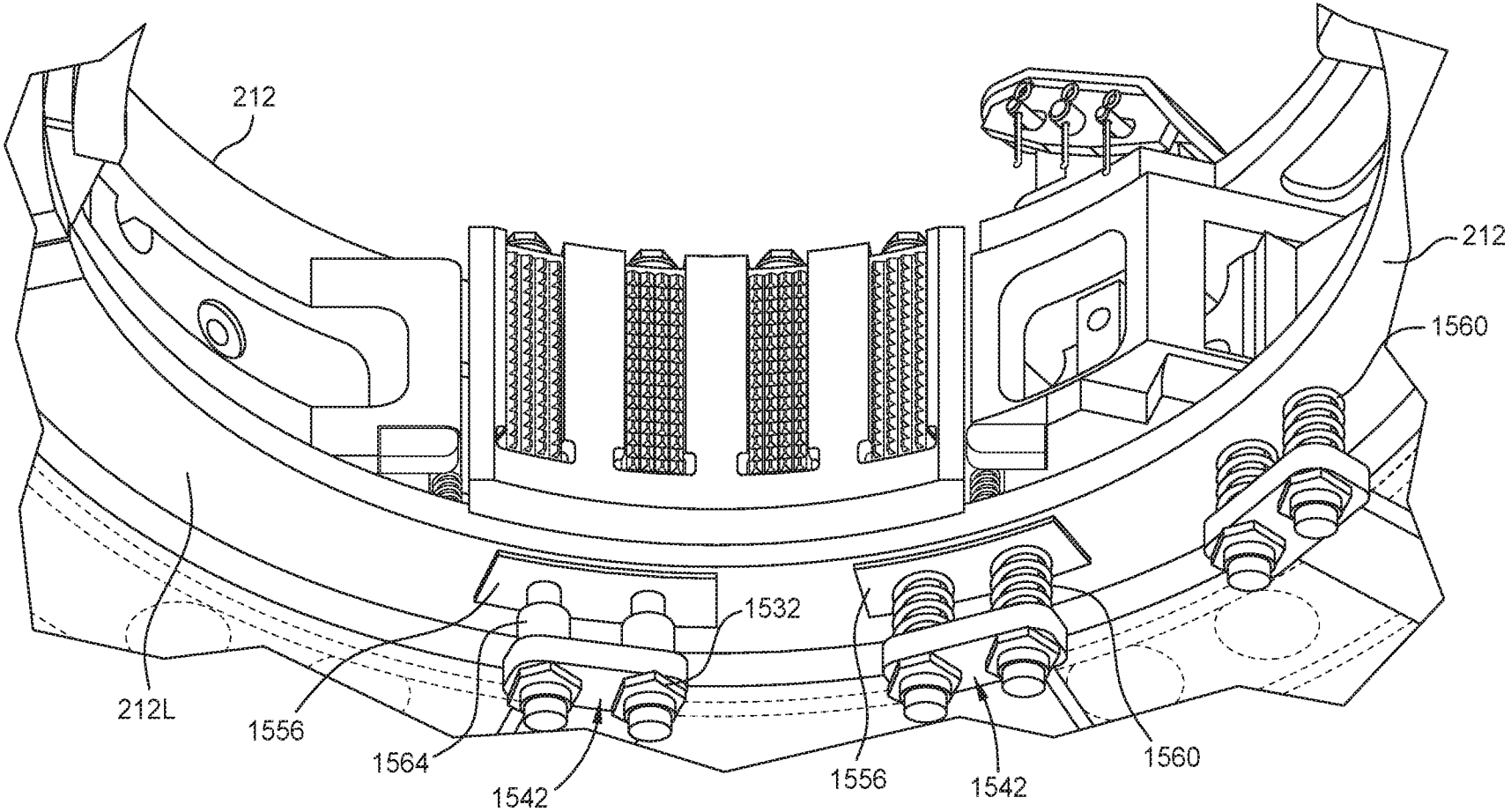
FIG. 16 is a partial, bottom view of the brake assembly of FIG. 14.

FIG. 14 illustrate another embodiment of a brake assembly 1520 suitable for use with the rotary gripping apparatus 200. FIG. 14 is a perspective view of the brake assembly 1520 attached to the rotary gripping apparatus 200. FIG. 15 is an enlarged, partial top view of the brake assembly 1520. FIG. 16 is a partial, bottom view of the brake assembly 1520. The brake assembly 1520 includes a first brake member and a second brake member such an upper brake 1541 and a lower brake 1542. The upper brake 1541 and lower brake 1542 are configured to engage the jaw carrier 212 to control rotation of the jaw carrier 212. In this respect, the jaw carrier 212 serves as the rotor for the brake assembly 1520.

As shown in FIG. 14, the upper brakes 1541 are attached to the top portion of the tong body 112 of the power tong 110. In some embodiments, the upper brake 1541 includes an arm portion 1547 and an engagement portion 1546. The arm portion 1547 is coupled to the tong body 112 and positions the engagement portion 1546 for engagement with an upper surface 212U of the jaw carrier 212, which may be a top surface of the jaw carrier 212. In the example as shown, the engagement portion 1546 has an arcuate shape. However, it is contemplated the engagement portion 1546 may have any suitable shape for engaging the jaw carrier 212. A plurality of upper brakes 1541 may be used to engage the jaw carrier 212. As shown in FIG. 14, four upper brakes 1541 are positioned to engage the active jaw portion 220, and four upper brakes are positioned to engage the passive jaw portion 240 of the jaw carrier 212. However, any suitable number and arrangement of the upper brakes 1541 may be used. For example, one, two, three, four, or more upper brakes 1541 may be used to engage the jaw carrier 212. In some embodiments, the engagement portion 1546 can include brake pads 1549 to facilitate engagement with the jaw carrier 212. The brake pads 1549 may be detachable from the engagement portion 1546 to facilitate replacement when worn. In some embodiments, the upper brakes 1541 are passive brakes that are in continuous contact with the jaw carrier 212 to apply a constant braking force. In another embodiment, an actuator 1550 is used to move the engagement portions 1546 into and out of engagement with the jaw carrier 212. An exemplary actuator 1550 is a piston and cylinder assembly. The piston and cylinder assembly is configured to move engagement portions 1546 into contact with the jaw carrier 212, thereby applying a braking force.

In some embodiments, the make/break switch 400 is moved forward (i.e., closer to the center) on the jaw carrier 212 to provide more clearance for the engagement portions 1546. As shown in FIG. 15, the make/break switch 400 has moved forward such that it will not contact the engagement portions 1546 during rotation.

In some embodiments, the lower brakes 1542 are attached to the bottom portion of the tong body 112 of the power tong 110. In some embodiments, the lower brakes 1542 are similar to the upper brakes and include an arm portion 1547 and an engagement portion 1546. The arm portion 1547 is coupled to the tong body 112 and positions the engagement portion 1546 for engagement with a lower surface 212L of the jaw carrier 212, which may be a bottom surface of the jaw carrier 212. It is contemplated the engagement portion 1546 of the lower brakes 1542 may have any suitable shape for engaging the jaw carrier 212. A plurality of lower brakes 1542 may be used to engage the jaw carrier 212. The lower brakes 1541 can be positioned around the tong body 112 to engage the active jaw portion 220 and the passive jaw portion 240 of the jaw carrier 212. Any suitable number and arrangement of the lower brakes 1542 may be used. For example, one, two, three, four, or more lower brakes 1542 may be used to engage the jaw carrier 212. The number of lower brakes 1542 may be the same or different than the number of upper brakes 1541 used. Because the upper brakes 1541 and the lower brakes 1542 are attached to different portions of the tong body 112, the upper brakes 1541 and the lower brakes 1542 are independently movable relative to each other. In some embodiments, the engagement portion 1546 can include brake pads 1549 to facilitate engagement with the jaw carrier 212. The brake pads 1549 may be detachable from the engagement portion 1546 to facilitate replacement when worn.

In another embodiment, the lower brakes 1542 includes an actuator for activating a brake pad 1556 of the lower brake 1542. For example, the actuator can be a spring 1560 for engaging the jaw carrier 212, as shown in FIGS. 14 and 16. As shown, each lower brake 1542 includes two springs 1560. However, any suitable number of springs, such as one, three, or more springs may be used. The springs 1560 are disposed on top of a mounting bracket 1532, which is attached to the bottom portion of the tong body 112. In some embodiments, each spring 1560 may be fitted with a brake pad 1556 for engaging the jaw carrier 212. The spring 1560 can urge the brake pad 1556 against the jaw carrier 212 to apply a constant braking force. In this respect, the brake pad 1556 can be considered the engagement portion. In embodiments where the spring 1560 directly contacts the jaw carrier 212, the spring 1560 is considered the engagement portion.

In another embodiment, the lower brakes 1542 use a piston and cylinder assembly 1564 as an actuator to urge the brake pads 1556 against the jaw carrier 212. The piston and cylinder assembly 1564 can be a pneumatically, hydraulically, or electrically operated. The piston and cylinder assembly 1564 is configured to compress the brake pads 1556 against the jaw carrier 212, thereby applying a braking force which can be controlled via pressure settings.

In some embodiments, the lower brakes 1542 are active brakes, and the upper brakes 1541 are passive brakes. For example, the lower brakes 1542 include an actuator to activate the brake pads 1556, and the upper brakes 1541 do not include an actuator. The upper brakes 1541 can apply a contact braking force on the jaw carrier 212. In another embodiment, the lower brakes 1542 are passive brakes and the upper brakes 1541 are active brakes. The upper brakes 1541 can include an actuator for urging the brake pads 1549 into contact with the jaw carrier 212. In yet another embodiment, the lower brakes 1542 and the upper brakes 1541 are both active brakes. For example, actuator activated brakes can be installed as the upper brakes and the lower brakes. In one example, the lower brakes 1542 can also be installed to act as the upper brakes.

In operation, the brake assembly 1520 engages the jaw carrier 212 to hold the jaw carrier 212 in a fixed position relative to the cam body 214, thereby preventing the jaw carrier 212 from rotating. In this embodiment, the upper brakes 1541 are passive brakes, and the lower brakes 1542 are active brakes. The lower brakes 1542 include an actuator such as a piston and cylinder assembly 1564 for urging the brake pads 1556 into engagement with the jaw carrier 212. The engagement portion 1546 of the upper brakes 1541 may be in contact with the jaw carrier 212 to apply a constant braking force. In this respect, the jaw carrier 212 is held in place by the upper brakes 1541 and the lower brakes 1542. Then, the cam body 214 is rotated relative to the jaw carrier 212 in a first direction to extend the active jaws 222*a,b*. The cam body 214 is rotated by the drive gear of the power tong 110 until the cam body 214 becomes rotationally locked with the jaw carrier 212. After reaching the rotationally locked position, the force applied by the drive gear to the cam body 214 is transferred to the jaw carrier 212. When the rotational force applied to the cam body 214 exceeds the brake force applied by the brake assembly 1520, i.e., the upper brakes 1541 and the lower brakes 1542, to the jaw carrier 212, the entire rotary gripping apparatus 200 will be rotated by the drive gear of the power tong 110. The lower brakes 1542 are then disengaged from the rotor 1580. In this respect, the actuator piston is retracted to move the brake pads 1556 to an open position. The entire rotary gripping apparatus 200 is rotated to make-up or break-out a tubular gripped by the passive jaws 244 and the active jaws 222. In some embodiments, the brake assembly 1520 can be automated such that the lower brakes 1542 automatically releases the jaw carrier 212 upon the full extension of the active jaws 222 to prevent excess wear on the brake pads. In some embodiments, the brake assembly 1520 may re-engage with the jaw 212 during the make-up or break-out operations to control the rotational speed of the rotary gripping apparatus 200.

In another example, the active jaws 222 may be retracted by first engaging the brake assembly 1520 with the jaw carrier 212 to prevent rotation of the jaw carrier 212 and then rotating the cam body 214 relative to the jaw carrier 212 in the opposite direction until the neutral alignment is reached. The brake assembly 1520 can be disengaged from the jaw carrier 212 once the neutral alignment is reached.

Various embodiments disclosed herein include brakes that engage a plurality of radially extending surfaces. An example includes brake device 1430 engaging upper and lower surfaces 1480U, 1480L of rotor segments 1482, 1484, 1486 as shown in FIGS. 12 and 13. Another example includes brakes 1541, 1542 engaging upper and lower surfaces 212U, 212L of the jaw carrier 212 as shown in FIG. 14. Other embodiments, based on these embodiments or any of the principles, disclosed herein include a brake member that engages a surface that extends in another direction such as an axially extending annular surface. Exemplary embodiments include brake assemblies that include a drum and shoe arrangement or a band brake.

In one embodiment, a tong for handling a tubular includes a jaw carrier having an active jaw movable from a retracted position to an extended position relative to the jaw carrier; a cam body disposed about the jaw carrier and rotatable relative to the cam body; and a brake assembly including an first brake member for engaging an upper surface coupled to the jaw carrier.

In one or more embodiments described herein, the brake assembly further includes a second brake member for engaging a lower surface coupled to the jaw carrier.

In one or more embodiments described herein, the first brake member and the second brake member are independently movable.

In one or more embodiments described herein, the first brake member is attached to an upper portion of the tong.

In one or more embodiments described herein, the second brake member is attached to a lower portion of the tong.

In one or more embodiments described herein, the first brake member comprises a passive brake and the second brake member comprises an active brake.

In one or more embodiments described herein, at least one of the first brake member and the second brake member comprises an arm portion and an engagement portion.

In one or more embodiments described herein, the tong further comprises an actuator for actuating at least one of the first brake member and the second brake member.

In one or more embodiments described herein, the brake assembly further includes a rotor coupled to the jaw carrier, and wherein the upper surface and the lower surface are surfaces on the rotor.

In one or more embodiments described herein, the tong includes a plurality of first brake members.

In one or more embodiments described herein, the upper surface is a surface of the jaw carrier.

In one or more embodiments described herein, the tong further comprises a passive jaw.

In another embodiment, a tong for handling a tubular includes a jaw carrier having an active jaw movable from a retracted position to an extended position, and a cam body disposed about the jaw carrier and rotatable relative to the cam body. The tong also includes a brake assembly having a rotor coupled to the jaw carrier and a brake device coupled to the tong and configured to engage the rotor to control rotation of the jaw carrier.

In one or more embodiments described herein, the brake device comprises a first brake arm pivotally coupled to a second brake arm.

In one or more embodiments described herein, the brake device further comprises an actuator for pivoting the first brake arm relative to the second brake arm.

In one or more embodiments described herein, the first and second brake arms include an engagement portion and a lever portion, wherein the actuator is coupled to the lever portion and the engagement portion is configured to engage the rotor.

In one or more embodiments described herein, the rotor is attached to a bottom portion of the jaw carrier.

In one or more embodiments described herein, the brake device is configured to engage a lip of the rotor.

In one or more embodiments described herein, the jaw carrier further comprises a passive jaw.

In another embodiment, a method of rotating a tubular using a tong includes inserting the tubular into the tong, the tong having a jaw carrier including an active jaw and a cam body; retaining the jaw carrier using a brake assembly; rotating the cam body relative to the jaw carrier to radially extend the active jaw into engagement with the tubular; and rotating the jaw carrier using the cam body. The method also includes disengaging the brake assembly from retaining the jaw carrier; and rotating the tubular gripped by the at least one active jaw.

In one or more embodiments described herein, the brake assembly comprises an upper brake for engaging a upper surface coupled to the jaw carrier; and a lower brake for engaging a lower surface coupled to the jaw carrier.

In one or more embodiments described herein, at least one of the upper brake and the lower brake comprises an active brake.

In one or more embodiments described herein, the brake assembly comprises a rotor attached to the jaw carrier; and a brake device coupled to the tong and configured to engage the rotor to control rotation of the jaw carrier.

In one or more embodiments described herein, the jaw carrier includes a plurality of active jaws.

While the foregoing is directed to embodiments of the present disclosure, other and further embodiments of the disclosure may be devised without departing from the basic scope thereof, and the scope thereof is determined by the claims that follow.

What is claimed is:

1. A tong for handling a tubular, comprising:

a jaw carrier having an active jaw movable from a retracted position to an extended position relative to the jaw carrier, and a passive jaw;

a cam body disposed about the jaw carrier and rotatable relative to the jaw carrier; and a brake assembly including a first brake member for engaging an upper surface coupled to the jaw carrier.

2. The tong of claim 1, wherein the brake assembly further comprises a second brake member for engaging a lower surface coupled to the jaw carrier.

3. The tong of claim 2, wherein the first brake member and the second brake member are independently movable.

4. The tong of claim 2, wherein the first brake member is attached to an upper portion of the tong.

5. The tong of claim 4, wherein the second brake member is attached to a lower portion of the tong.

6. The tong of claim 2, wherein the first brake member comprises a passive brake and the second brake member comprises an active brake.

7. The tong of claim 2, wherein at least one of the first brake member and the second brake member comprises an arm portion and an engagement portion.

8. The tong of claim 2, further comprising an actuator for actuating at least one of the first brake member and the second brake member.

9. The tong of claim 2, wherein the brake assembly further includes a rotor coupled to the jaw carrier, and wherein the upper surface and the lower surface are surfaces on the rotor.

10. The tong of claim 1, wherein the tong includes a plurality of first brake members.

11. The tong of claim 1, wherein the upper surface is a surface of the jaw carrier.

12. A method of rotating a tubular using a tong, comprising:

inserting the tubular into the tong, the tong having a jaw carrier including at least one active jaw, at least one passive jaw, and a cam body;

retaining the jaw carrier using a brake assembly;

rotating the cam body relative to the jaw carrier to radially extend the at least one active jaw into engagement with the tubular;

rotating the jaw carrier using the cam body;

disengaging the brake assembly from retaining the jaw carrier; and rotating the tubular gripped by the at least one active jaw.

13. The method of claim 12, wherein the brake assembly comprises an upper brake for engaging an upper surface coupled to the jaw carrier; and a lower brake for engaging a lower surface coupled to the jaw carrier.

14. The method of claim 13, wherein at least one of the upper brake and the lower brake comprises an active brake.

15. The method of claim 13, wherein the upper brake and the lower brake are independently movable relative to each other.

* * * * *